US008705993B2

(12) United States Patent
Mori et al.

(10) Patent No.: US 8,705,993 B2
(45) Date of Patent: Apr. 22, 2014

(54) ELECTROSTATIC IMAGE FORMING APPARATUS UTILIZING INDEX PATTERNS FOR TONER IMAGE ALIGNMENT

(75) Inventors: Yuri Mori, Tokyo (JP); Yoshihiro Shigemura, Yokohama (JP); Ryo Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 13/295,522

(22) Filed: Nov. 14, 2011

(65) Prior Publication Data

US 2012/0121283 A1 May 17, 2012

(30) Foreign Application Priority Data

Nov. 15, 2010 (JP) ..... 2010-254481

(51) Int. Cl.
*G03G 15/00* (2006.01)
*G03G 15/16* (2006.01)

(52) U.S. Cl.
USPC ..... 399/66; 399/49; 399/72

(58) Field of Classification Search
USPC ..... 399/49, 66, 301
See application file for complete search history.

(56) References Cited

U.S. PATENT DOCUMENTS

| | | | | |
|---|---|---|---|---|
| 5,995,802 | A * | 11/1999 | Mori et al. | 399/394 |
| 7,885,570 | B2 * | 2/2011 | Koie | 399/71 |
| 8,023,845 | B2 | 9/2011 | Inoue | |
| 8,059,978 | B2 * | 11/2011 | Mizushima et al. | 399/45 |
| 8,295,721 | B2 * | 10/2012 | Murayama | 399/49 |
| 8,391,757 | B2 * | 3/2013 | Mizushima et al. | 399/301 |
| 2004/0141765 | A1 * | 7/2004 | Shimura et al. | 399/49 |
| 2004/0208661 | A1 * | 10/2004 | Kitagawa et al. | 399/49 |
| 2005/0100356 | A1 * | 5/2005 | Yang et al. | 399/49 |
| 2008/0089702 | A1 * | 4/2008 | Takezawa et al. | 399/32 |
| 2008/0089706 | A1 * | 4/2008 | Nakazato et al. | 399/44 |
| 2008/0226313 | A1 * | 9/2008 | Tsuchida et al. | 399/44 |
| 2008/0240765 | A1 * | 10/2008 | Shida | 399/79 |
| 2009/0123197 | A1 * | 5/2009 | Okumura et al. | 399/301 |
| 2010/0054773 | A1 * | 3/2010 | Ogura | 399/48 |
| 2010/0142984 | A1 * | 6/2010 | Okumura et al. | 399/66 |
| 2010/0209124 | A1 * | 8/2010 | Mizutani et al. | 399/16 |
| 2010/0226696 | A1 * | 9/2010 | Shihoh et al. | 399/301 |
| 2011/0158670 | A1 * | 6/2011 | Fuchimoto | 399/66 |
| 2012/0008995 | A1 * | 1/2012 | Shigemura et al. | 399/301 |
| 2012/0107024 | A1 * | 5/2012 | Shimizu et al. | 399/301 |

FOREIGN PATENT DOCUMENTS

| | | | |
|---|---|---|---|
| JP | 10-039571 | A | 2/1998 |
| JP | 11-183542 | A | 7/1999 |
| JP | 2003-066677 | A | 3/2003 |
| JP | 2004-145077 | A | 5/2004 |
| JP | 2010-060761 | A | 3/2010 |

* cited by examiner

*Primary Examiner* — Walter L Lindsay, Jr.
*Assistant Examiner* — David Bolduc
(74) *Attorney, Agent, or Firm* — Fitzpatrick, Cella, Harper & Scinto

(57) ABSTRACT

An image forming apparatus includes movable first and second image bearing members, latent image forming units that form electrostatic latent images and latent index patterns, a movable belt member contacting the image bearing members, toner image transfer members that transfer toner images, obtained by depositing toner on the latent images, onto the belt member, latent pattern detectors that detect the latent index patterns, an adjusting portion that adjusts relative positions between the latent index patterns on the basis of detection results of the detectors, and a setting portion that sets a latent pattern transfer voltage, during image formation, on the basis of a detection result of one of the latent pattern detectors on condition that a plurality of test voltages are applied to one of the latent pattern transfer member during non-image formation.

10 Claims, 25 Drawing Sheets

(a)

(b)

ELECTROSTATIC IMAGE FORMING APPARATUS UTILIZING INDEX PATTERNS FOR TONER IMAGE ALIGNMENT

FIELD OF THE INVENTION AND RELATED ART

The present invention relates to an image forming apparatus in which an electrostatic index image formed on an image bearing member is transferred onto a belt member to effect positioning (positional) alignment of a plurality of toner images. Specifically, control for setting an electrical condition when the electrostatic index image is transferred onto the belt member.

An image forming apparatus in which a plurality of toner images formed on an image bearing member (photosensitive drum or the like) are superposed by using a belt member (intermediary transfer belt or recording material conveyer belt) has been widely used (FIG. 1). In the case of superposing the toner images by using the belt member, there is a need to accurately positionally align, with a first transferred toner image, a subsequently transferred toner image. For this reason, various indices provided correspondingly to the toner images for an image formed on the image bearing member are recorded (formed) on the belt member and then are used for positional alignment (or adjustment of formation timing) of the subsequently transferred toner image (Japanese Laid-Open Patent application (JP-A) Hei 10-39571 and JP-A 2004-145077).

In JP-A Hei 10-39571, in order to adjust timing of formation of electrostatic images for images on a plurality of photosensitive drum, in advance of image formation, electrostatic index images for positioning are formed on the plurality of image bearing members and then are transferred onto the recording material conveyer belt.

In JP-A 2004-145077, in order to positionally aligning the toner image on the photosensitive drum with the toner image for the image transferred onto the intermediary transfer belt in real time, a scale (code) pattern is magnetically recorded on a magnetic recording track of the intermediary transfer belt.

In JP-A 2003-066677, toner image indices simultaneously formed on the plurality of photosensitive drums are transferred onto a recording material conveyer belt and then are detected by an optical sensor at a downstream side of the plurality of photosensitive drums to adjust exposure start timing for each of the photosensitive drums.

In JP-A 2010-60761, an antenna potential sensor capable of detecting the electrostatic index images formed on the image bearing member (photosensitive drum) is described. The antenna potential sensor is very small in size and in addition, outputs a detection signal of a differential waveform of a potential distribution on the detecting surface when the sensor passes through the electrostatic index images, so that the antenna potential sensor can precisely detect the positions of the electrostatic images.

In the case where toner image superposition is controlled by using the magnetically recorded index as described in JP-A 2004-145077, there is a need to add a device for effecting writing/reading of the magnetically recorded index. Further, there is a possibility that an error of 100μ-level occurs between the magnetically recorded index and the electrostatic image for an image formed on the photosensitive drum by an exposure device, so that the positional alignment of the toner images is effected with difficulty when it is effected with accuracy of a scanning line level.

Therefore, as shown in FIG. 1, it has been proposed that an electrostatic scale image 31*a* is formed on a photosensitive drum 12*a* in synchronism with scanning line exposure of the electrostatic image for the image and then is transferred onto an intermediary transfer belt 24. In this case, on a downstream side photosensitive drum 12*b*, the electrostatic scale image 31*a* is detected by using an antenna potential sensor to positionally align the toner image on the photosensitive drum 12*b* with the toner image on the intermediary transfer belt 24.

However, in the case where the electrostatic scale image 31*a* is detected by using the antenna potential sensor, it was turned out that accuracy of the toner image superposition is lowered due to accumulation of image formation, a change in temperature and humidity, or the like. Further, as a result of study, due to the accumulation of image formation, the change in temperature and humidity, or the like, a transfer voltage when the electrostatic scale image 31*a* is transferred from the photosensitive drum 12*a* onto the intermediary transfer belt 24 becomes improper, with the result that it was turned out that detection accuracy of the electrostatic scale image 31*a* is lowered.

SUMMARY OF THE INVENTION

A principal object of the present invention is to provide an image forming apparatus capable of maintaining superposition accuracy of toner images at a high level by properly transferring an electrostatic index image onto a belt member even when accumulation of image formation, a change in temperature and humidity, or the like occurs.

According to an aspect of the present invention, there is provided an image forming apparatus comprising: a plurality of image bearing members; electrostatic image forming means for forming an electrostatic image on each of the image bearing members; a belt member for carrying a toner image transferred from each of the image bearing member; an electrostatic image transfer member for transferring an electrostatic index image, onto an electrostatic image transfer area located adjacent to an image area of the toner image with respect to a widthwise direction of the belt member, formed on the upstreammost image bearing member with respect to a rotational direction of the belt member; an antenna potential sensor for detecting an induced current, with rotation of the belt member, of the electrostatic index image in the electrostatic image transfer area; control means for controlling superposition of the toner images, formed on the image bearing members and to be transferred onto the image area, through detection of the electrostatic index image in the electrostatic image area by the antenna potential sensor; and setting means for setting an electrical condition, when the electrostatic index image is transferred onto the electrostatic image transfer area during image formation, on the basis of a detection result of the electrostatic index image which is formed during non-image formation, transferred onto the electrostatic image area under an electrical condition different from that during the image formation, and then is detected by the antenna potential sensor.

These and other objects, features and advantages of the present invention will become more apparent upon a consideration of the following description of the preferred embodiments of the present invention taken in conjunction with the accompanying drawings.

Figure 6:
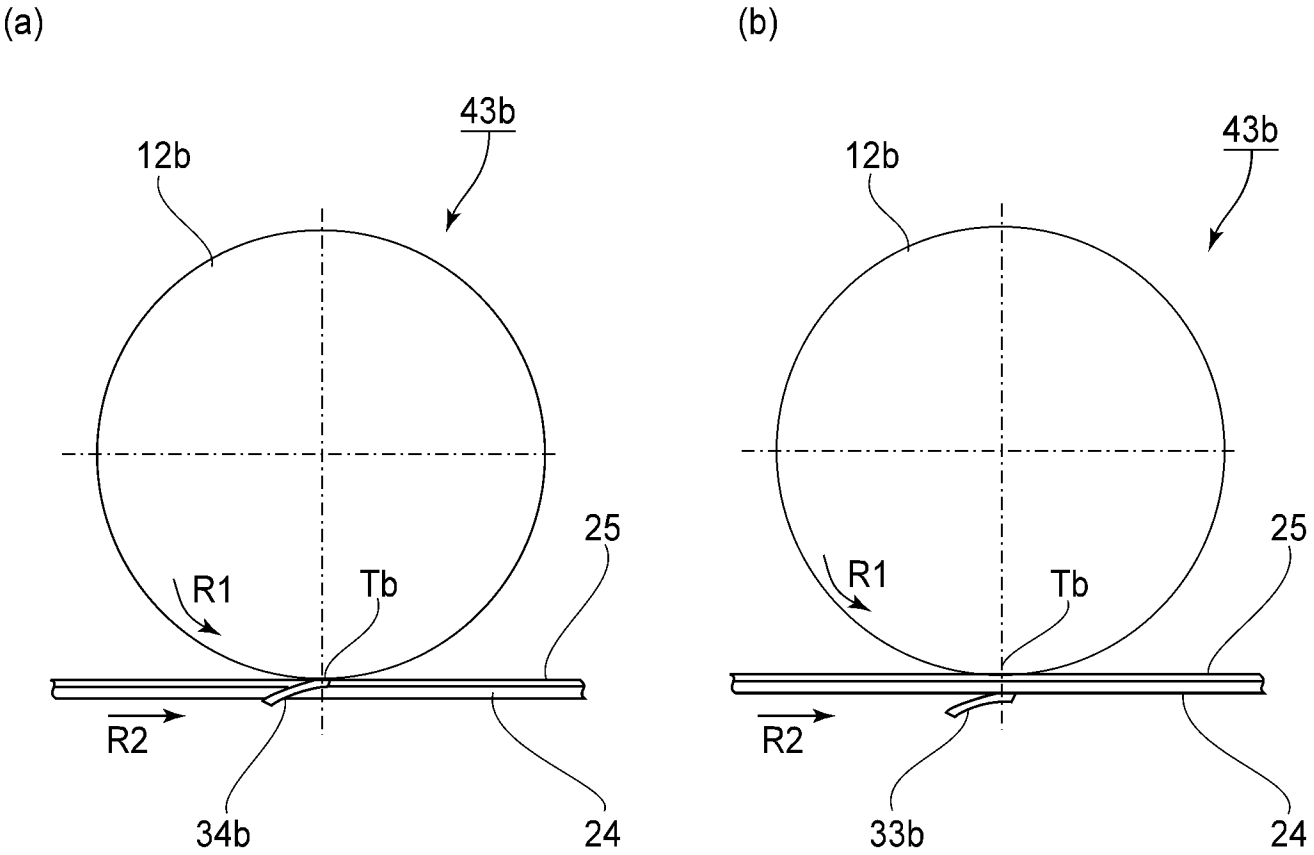

Parts (a) and (b) of FIG. 6 are illustrations of arrangement of an antenna potential sensor.

Figure 7:
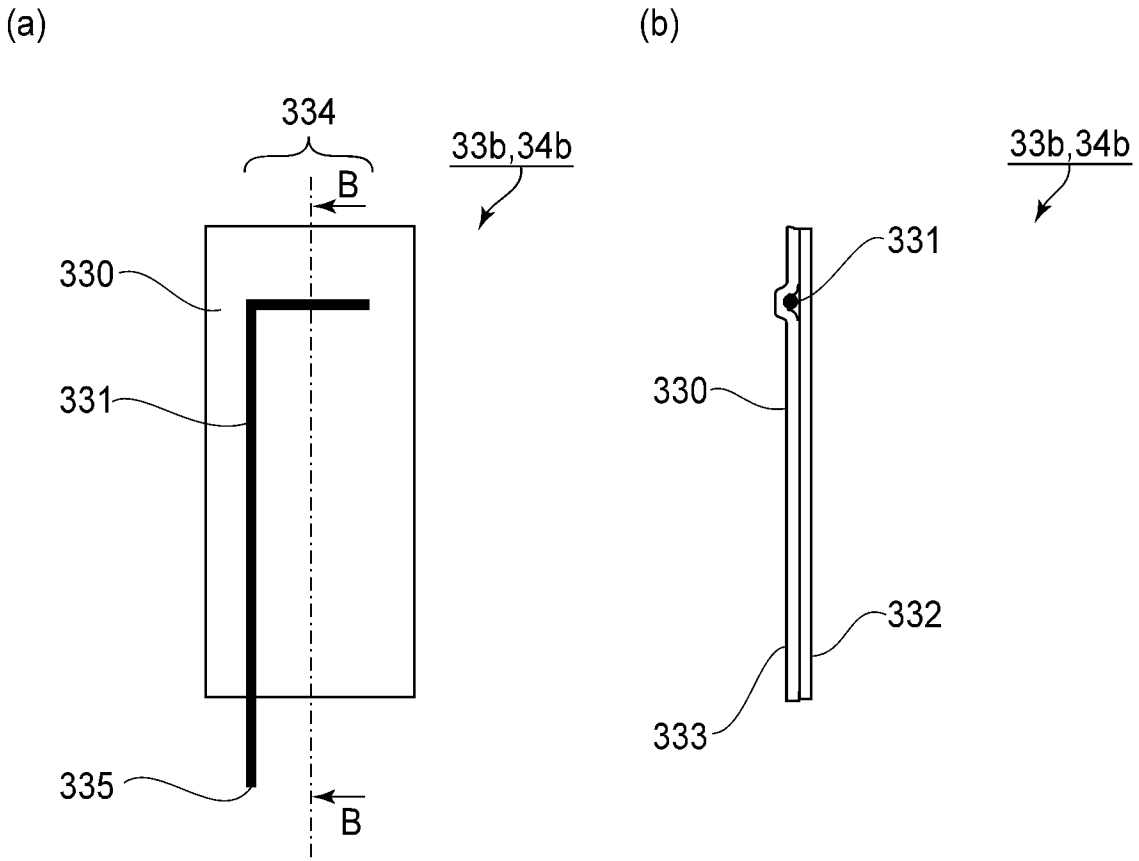

Parts (a) and (b) of FIG. 7 are illustrations of a structure of the antenna potential sensor.

Figure 8:
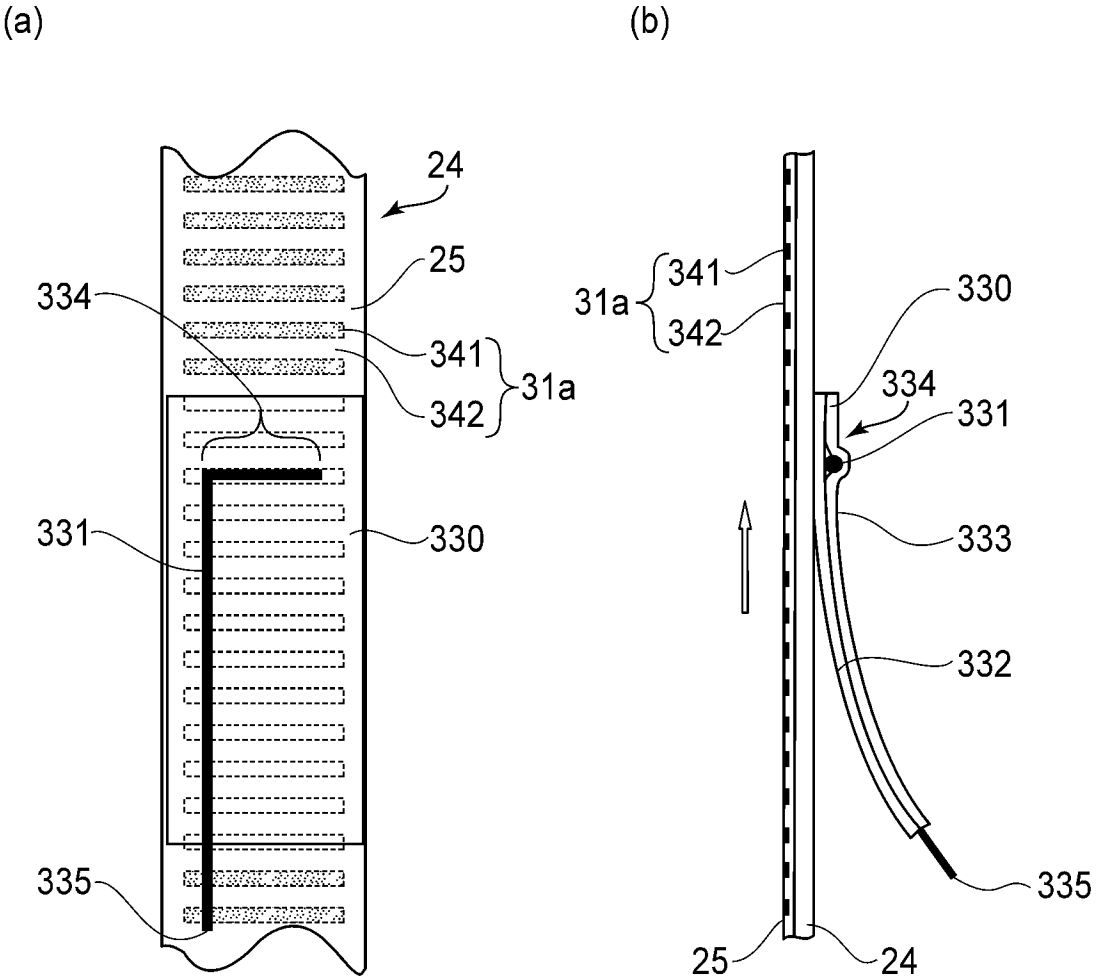

Parts (a) and (b) of FIG. 8 are illustrations of reading of the electrostatic scale image by the antenna potential sensor.

Figure 9:
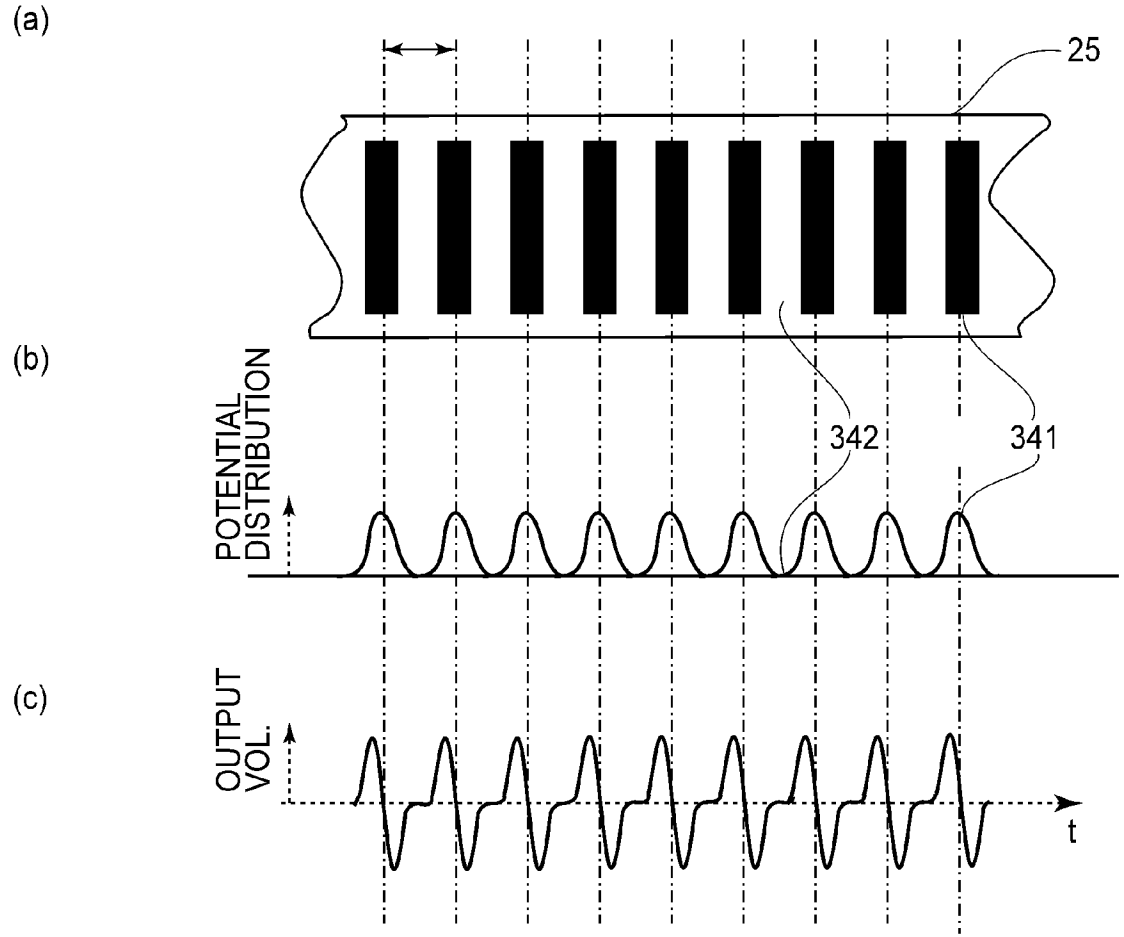

Parts (a), (b) and (c) of FIG. 9 are illustrations of output signals of the antenna potential sensor.

Figure 10:
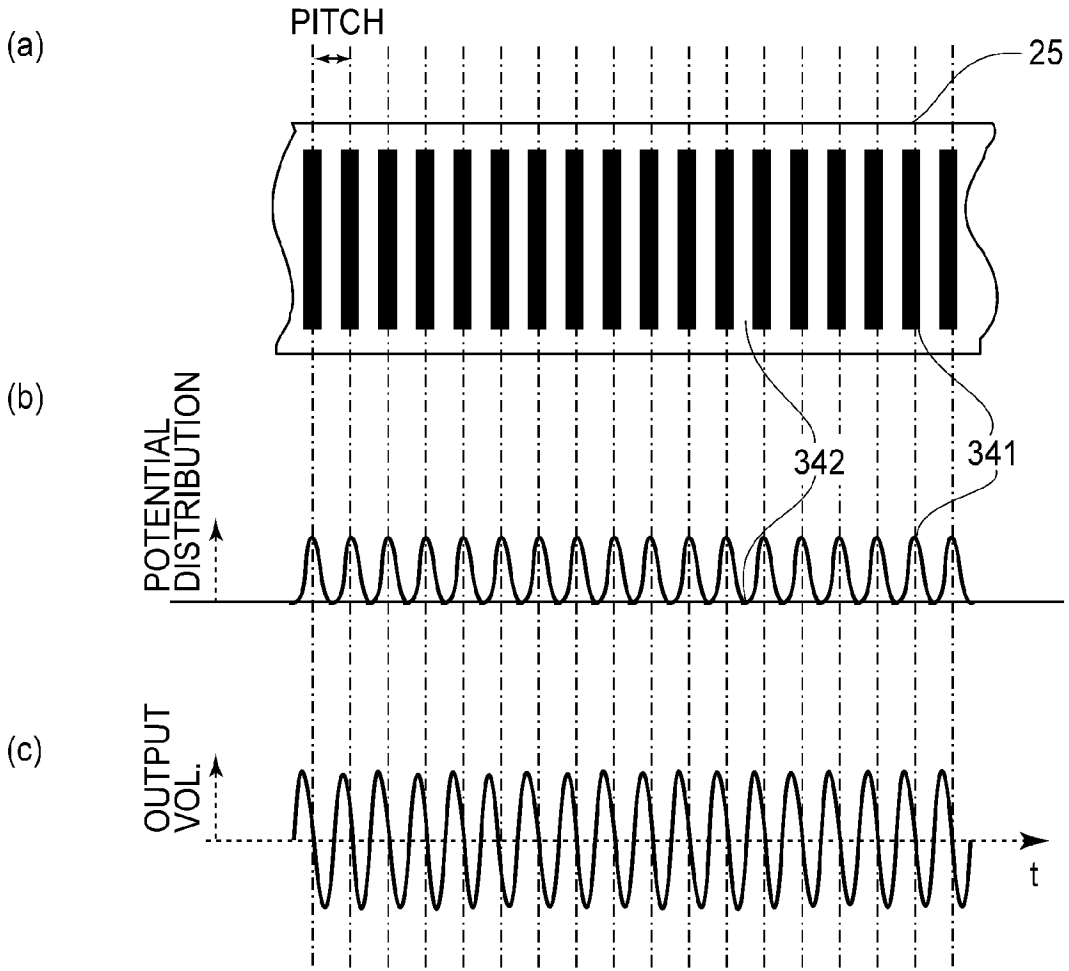

Parts (a), (b) and (c) of FIG. 10 are illustrations of signal waveforms of the output signals.

Figure 11:
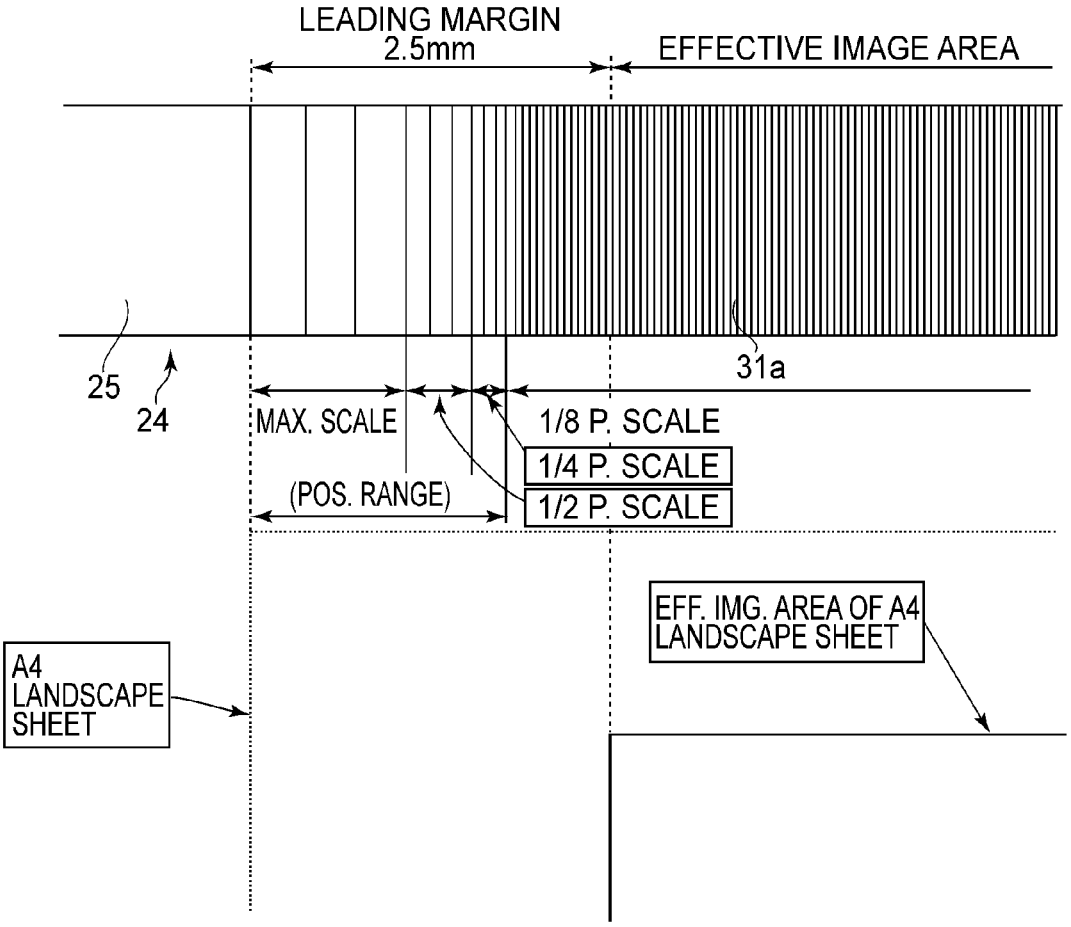

FIG. 11 is an enlarged view of the electrostatic scale image at a leading end of an image on the intermediary transfer belt.

Figure 12:
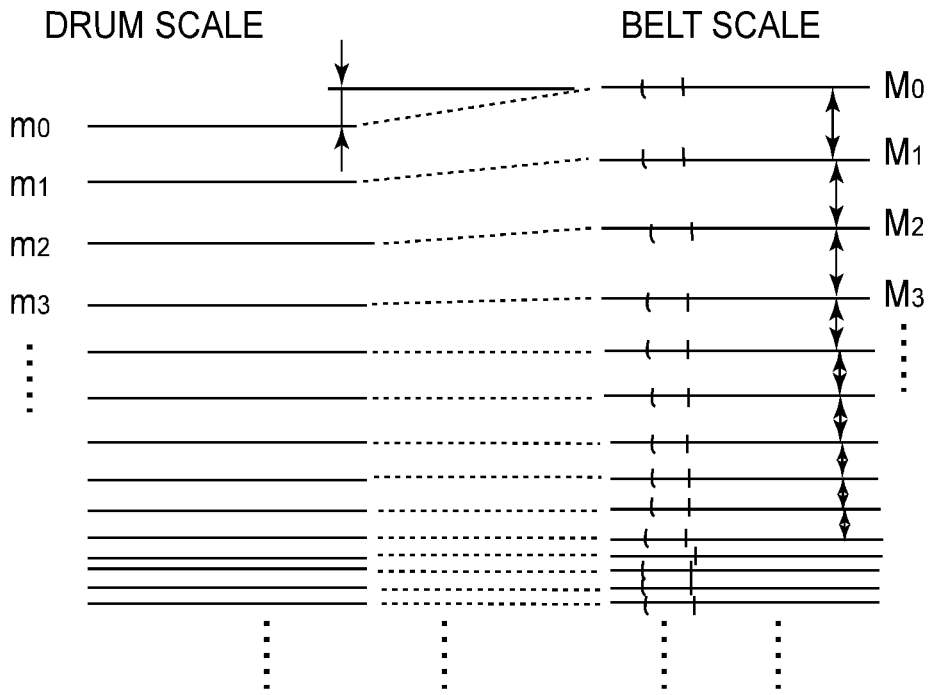

FIG. 12 is an illustration of scale alignment between a photosensitive drum and the intermediary transfer belt.

Figure 13:
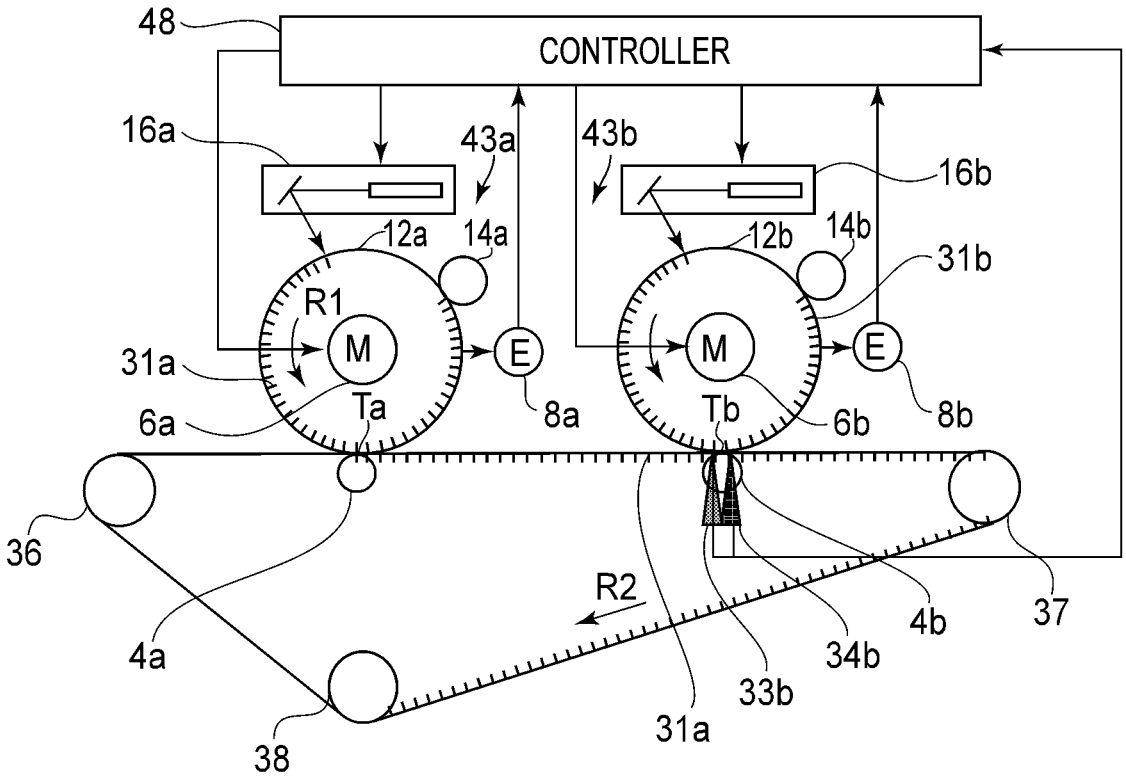

FIG. 13 is a block diagram of scale alignment control.

Figure 14:
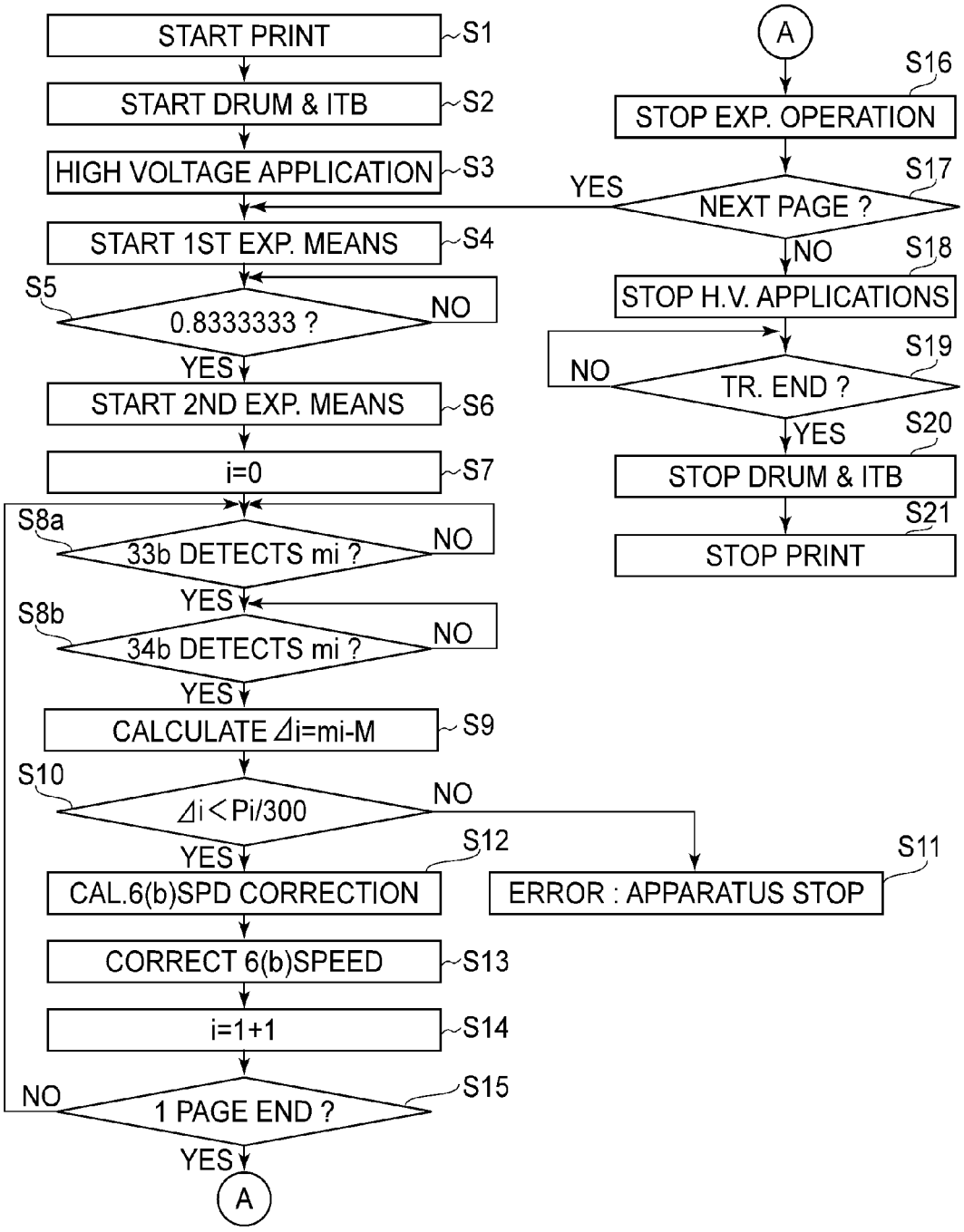

FIG. 14 is a flow chart of the scale alignment control.

Figure 15:
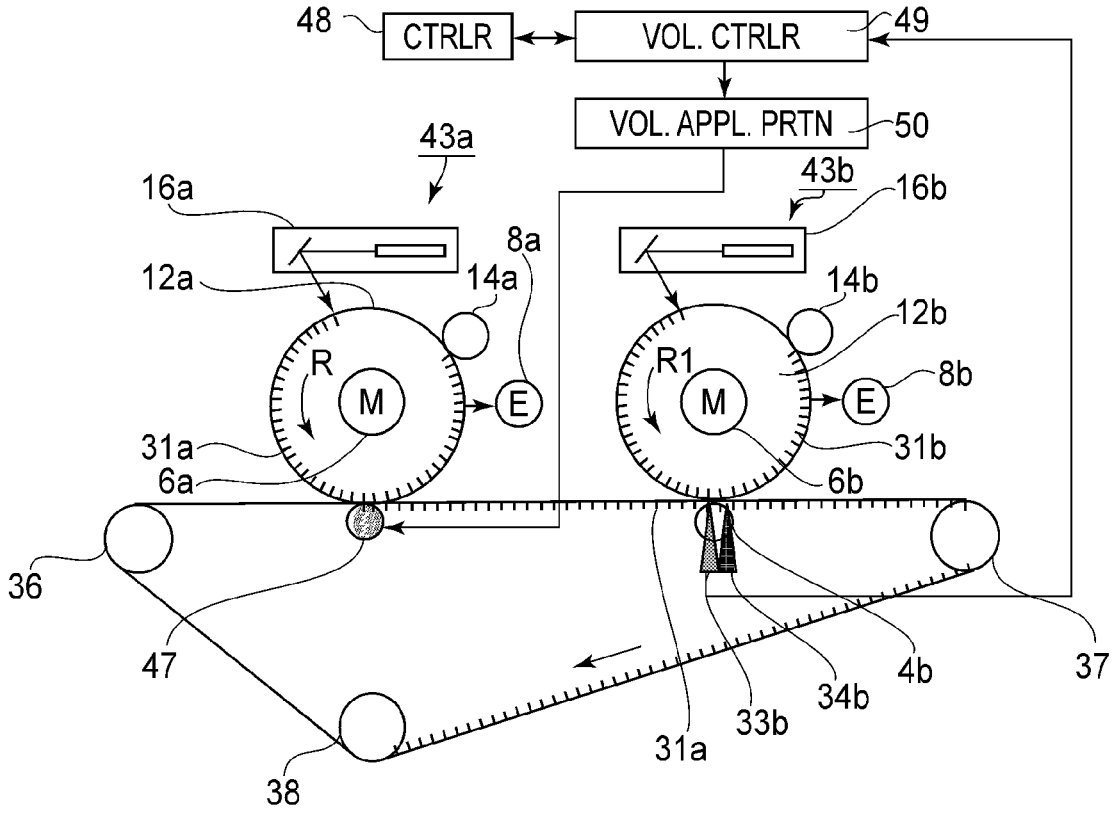

FIG. 15 is a block diagram of control when an electrostatic image transfer voltage is optimized.

Figure 16:
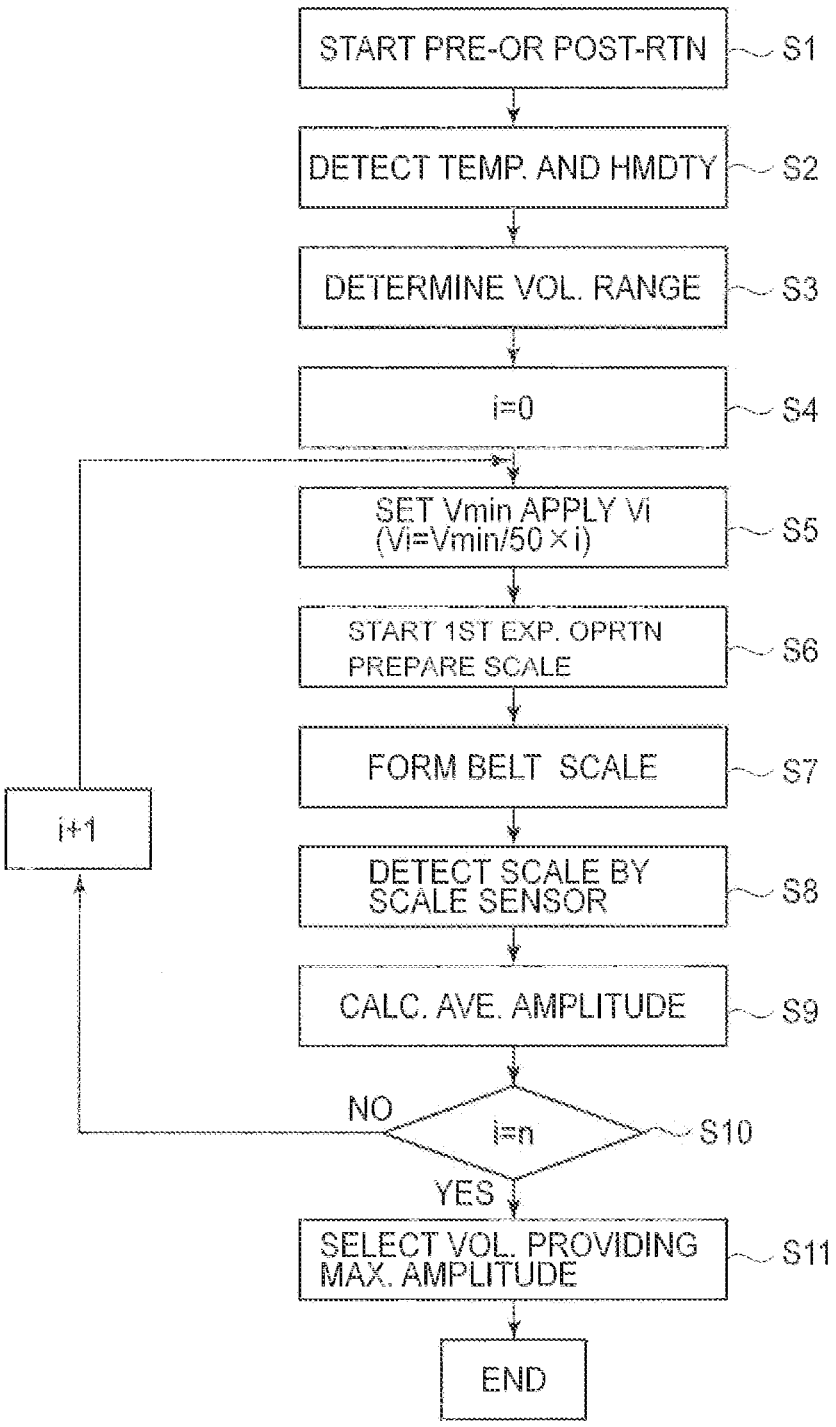

FIG. 16 is a flow chart of electrostatic image transfer voltage setting control in Embodiment 1.

Figure 17:
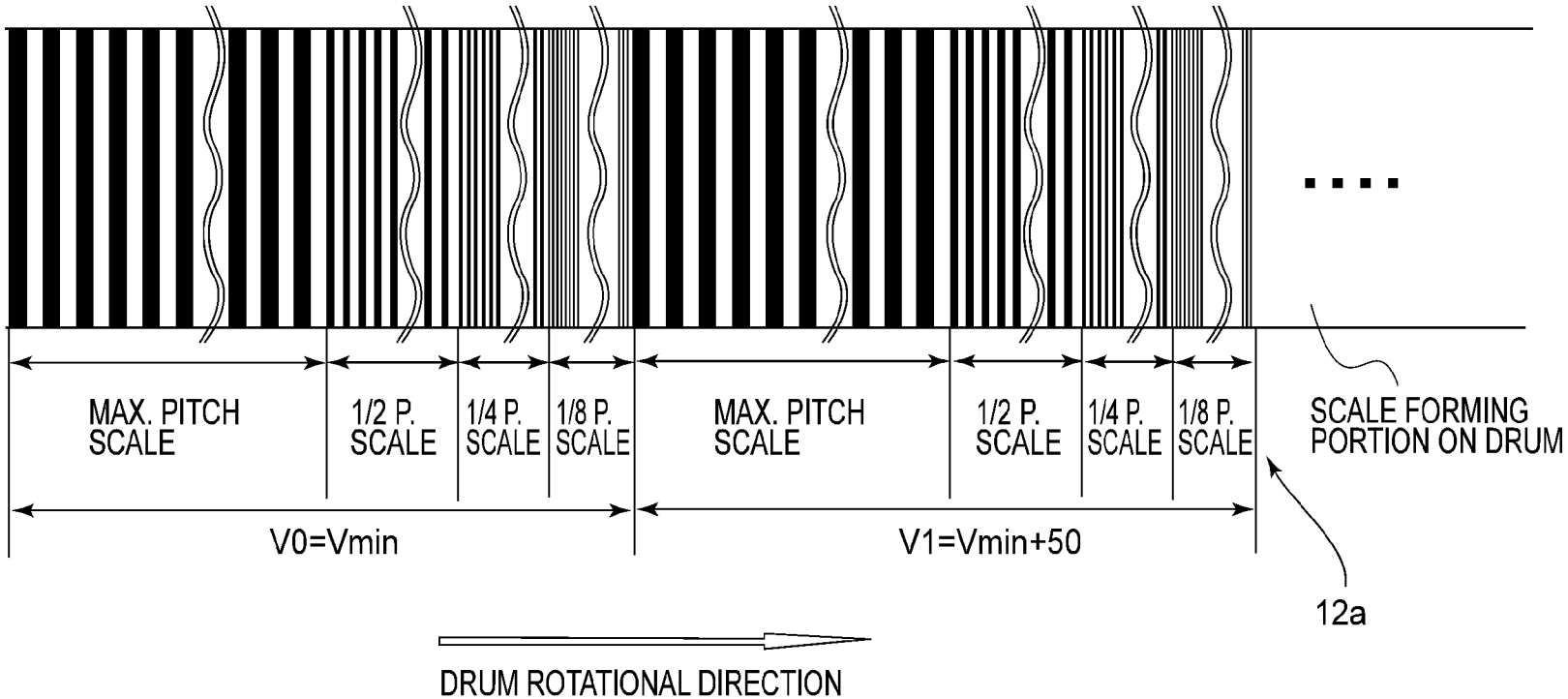

FIG. 17 is an illustration of an electrostatic image setting pattern.

Figure 18:
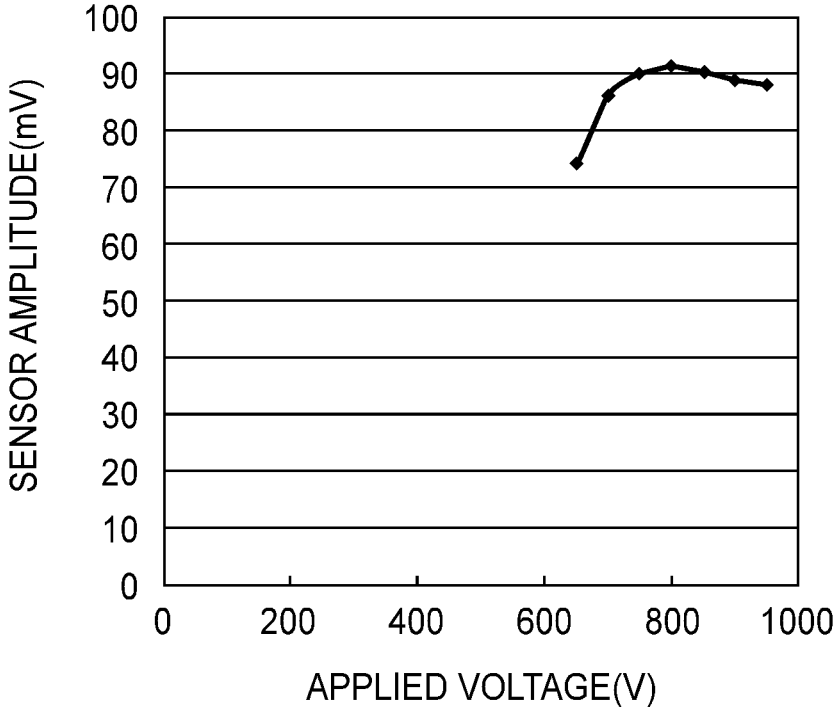

FIG. 18 is a graph for illustrating an optimum electrostatic image transfer voltage.

Figure 19:
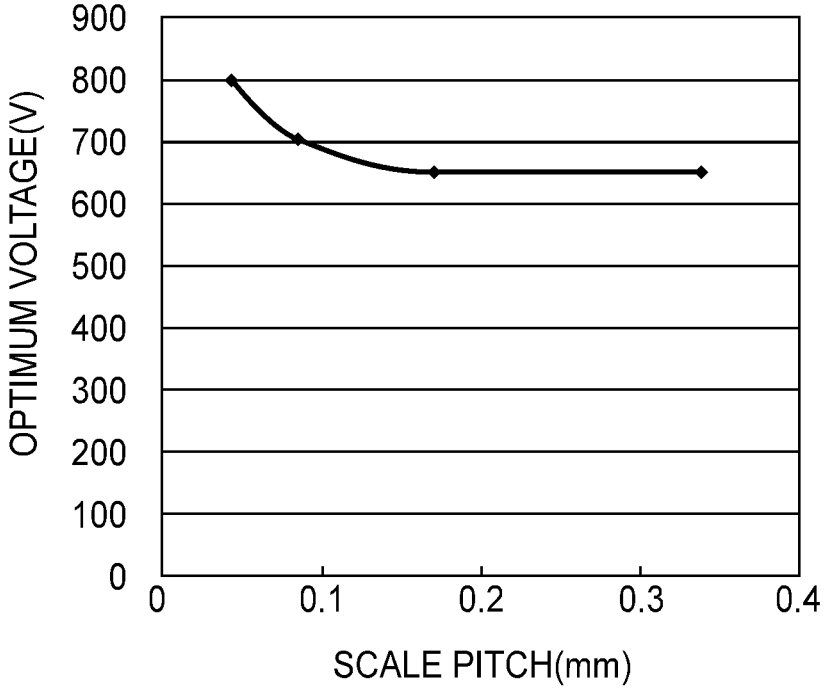

FIG. 19 is a graph showing a relationship between an electrostatic scale image pitch and the optimum electrostatic image transfer voltage.

Figure 20:
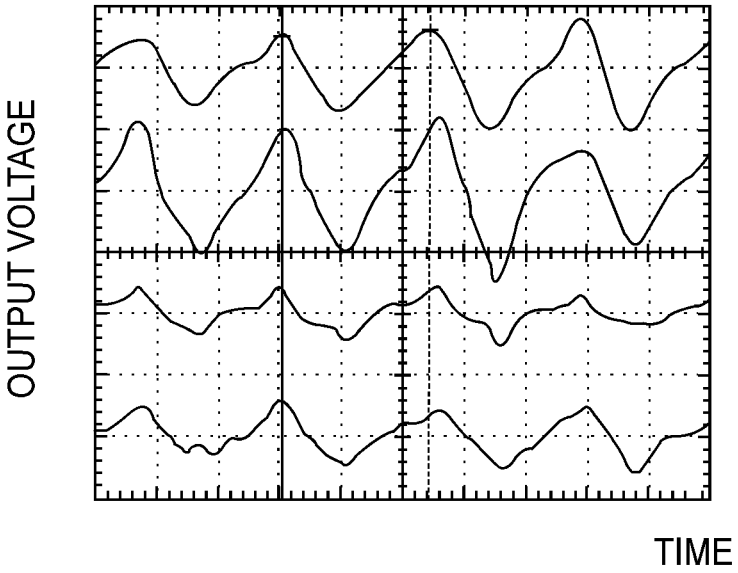
Figure 20:
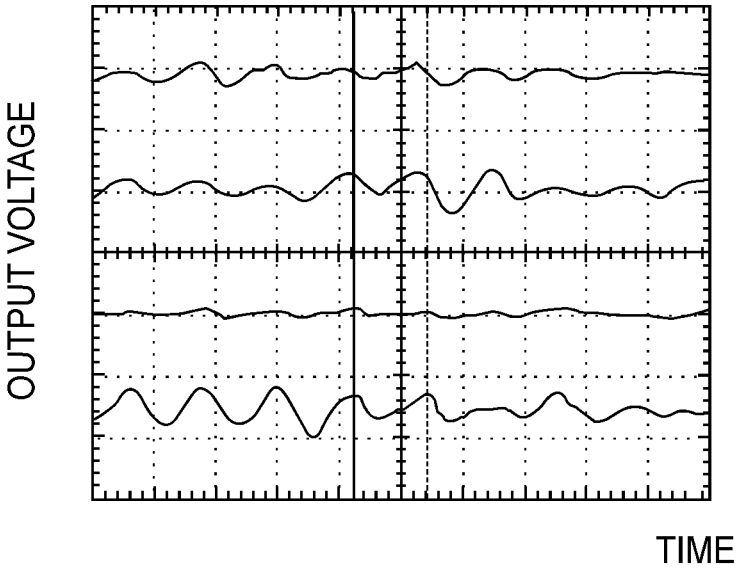

Parts (a) and (b) of FIG. 20 are graphs each showing a relationship between a time and an output voltage (amplitude of a detection signal) with respect to the electrostatic scale image pitch.

Figure 21:
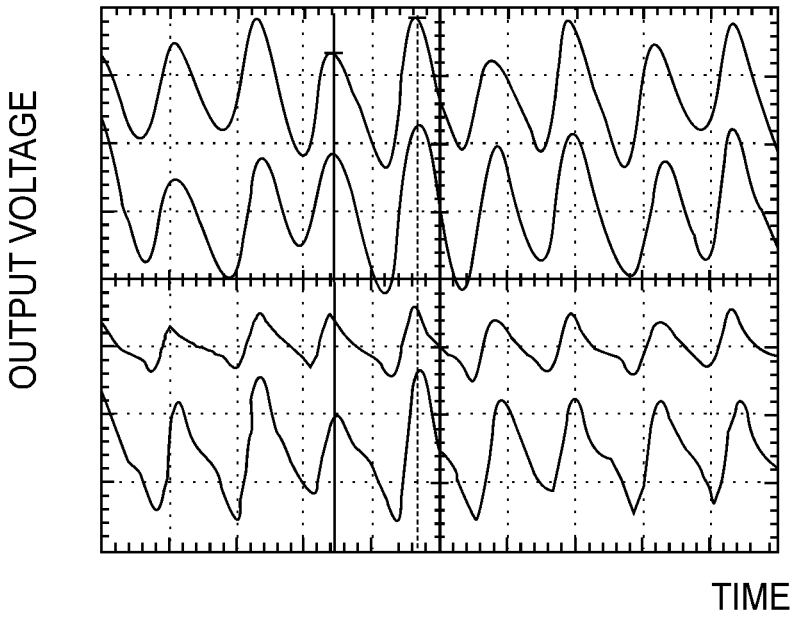

FIG. 21 is a graph for illustrating a difference in amplitude of the detection signal depending on the electrostatic image transfer voltage.

Figure 22:
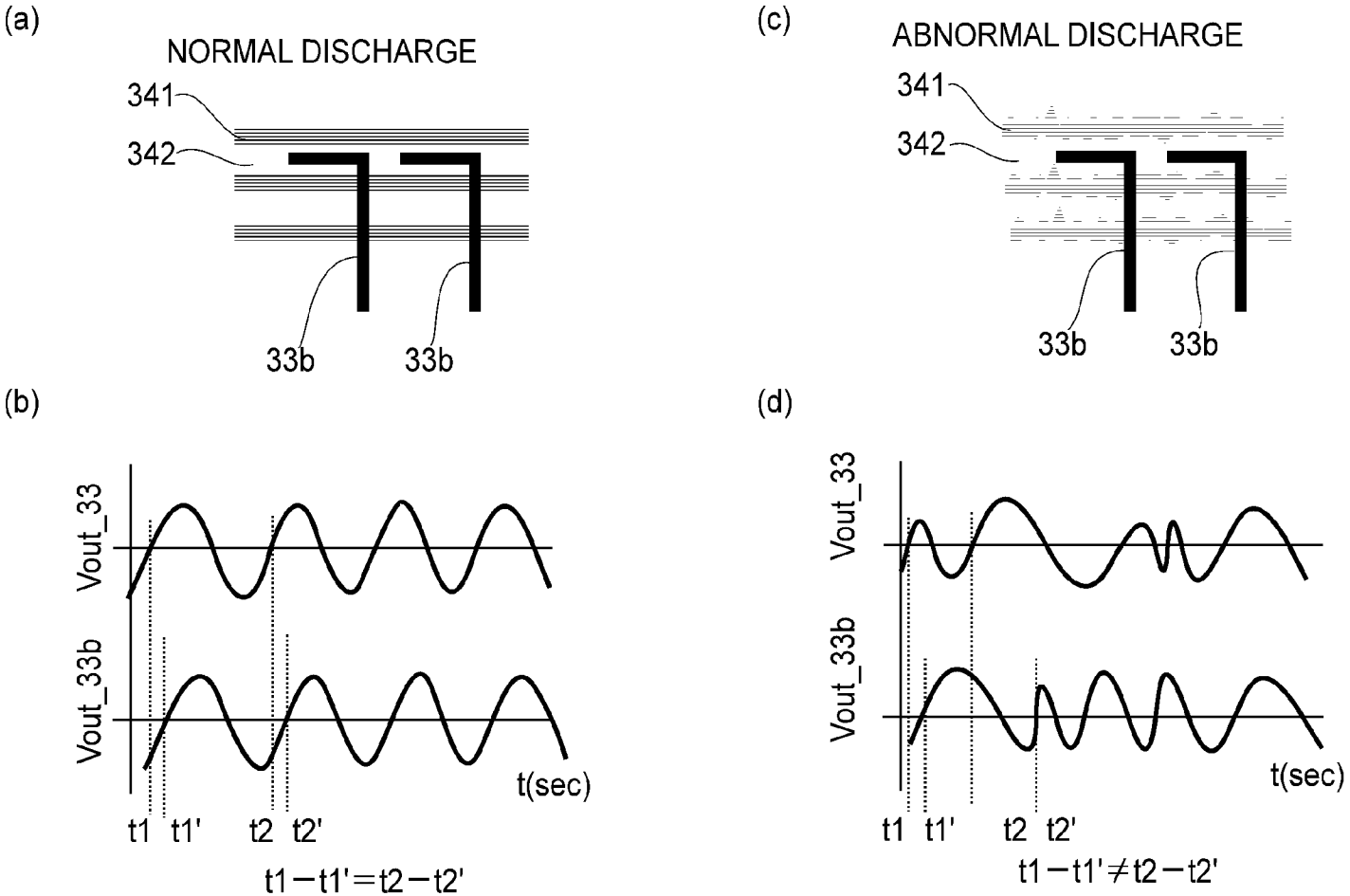

Parts (a) to (d) of FIG. 22 are illustrations of arrangement of potential sensors in Embodiment 2.

Figure 23:
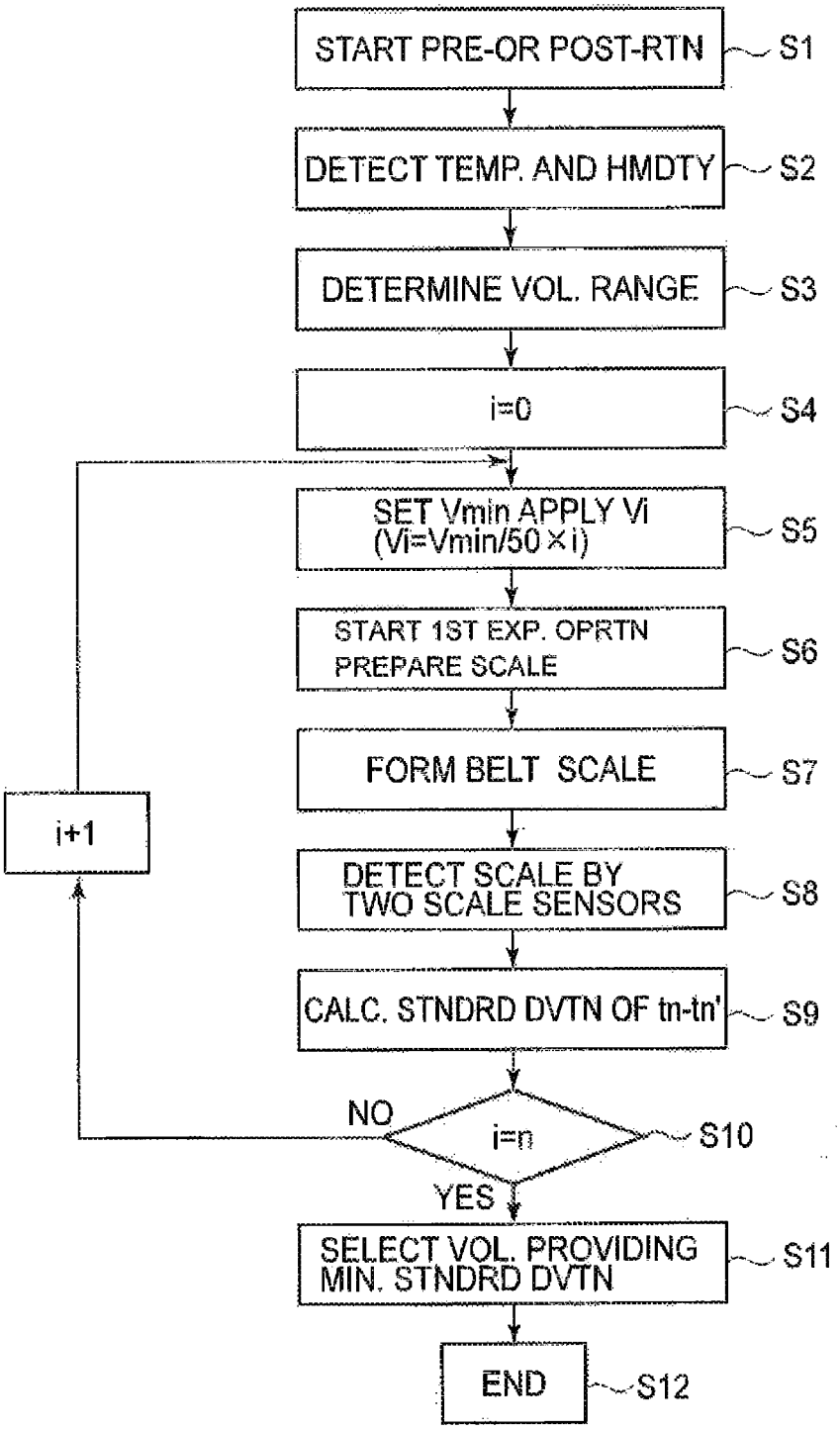

FIG. 23 is a flow chart of electrostatic image transfer voltage setting control in Embodiment 2.

Figure 24:
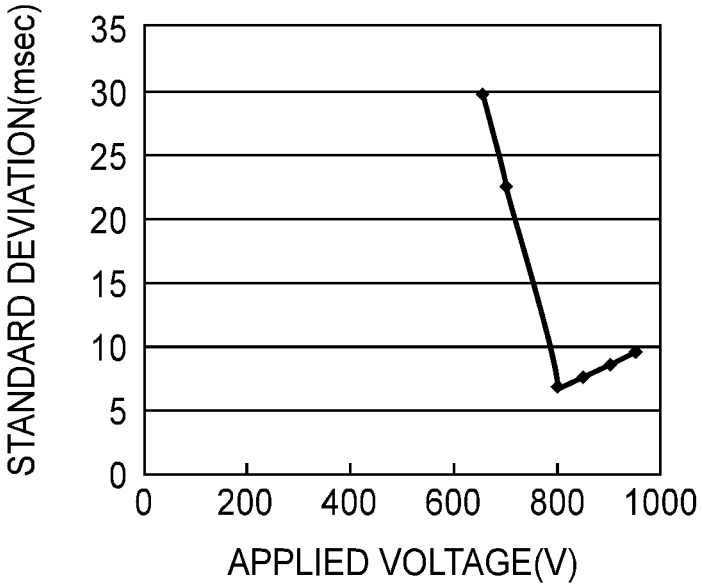

FIG. 24 is a graph showing a relationship between an electrostatic image transfer voltage and standard deviation of a detection signal.

Figure 25:
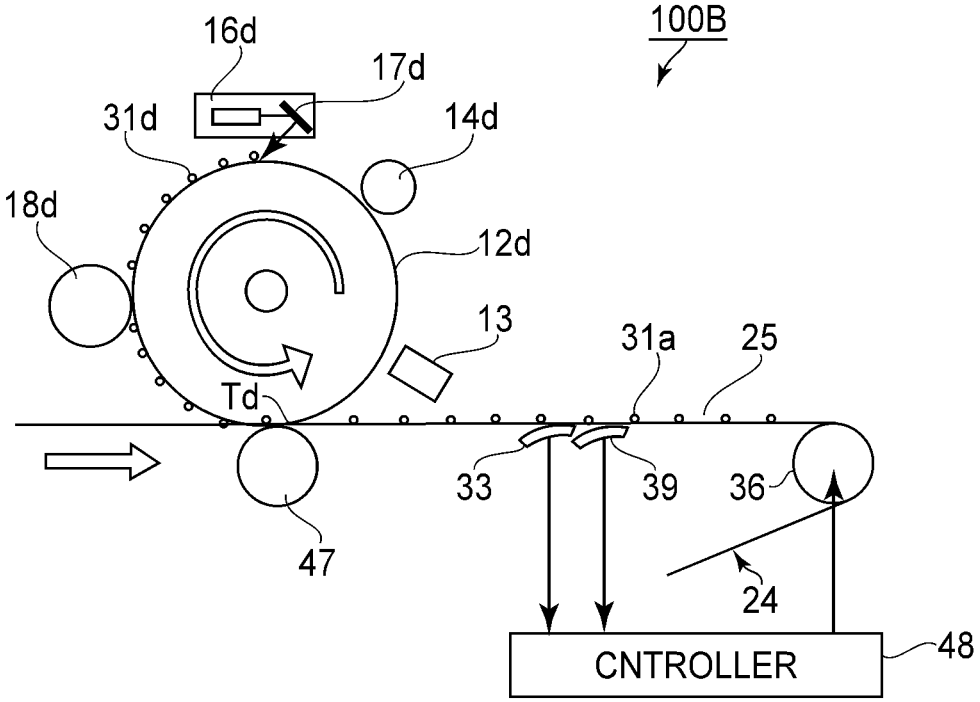

FIG. 25 is an illustration of color misregistration correction control during image formation in Embodiment 3.

Figure 26:
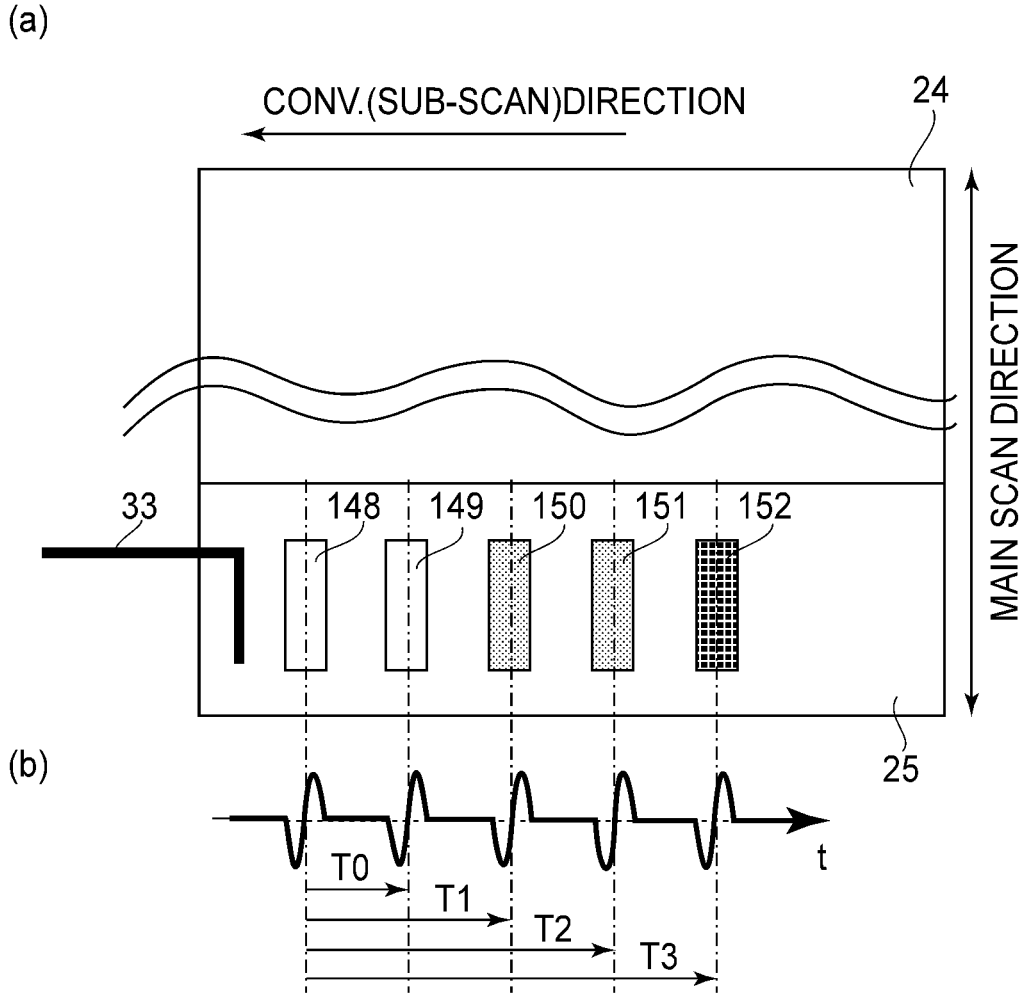

Parts (a) and (b) of FIG. 26 are illustrations of color misregistration correction control in Embodiment 4.

Figure 27:
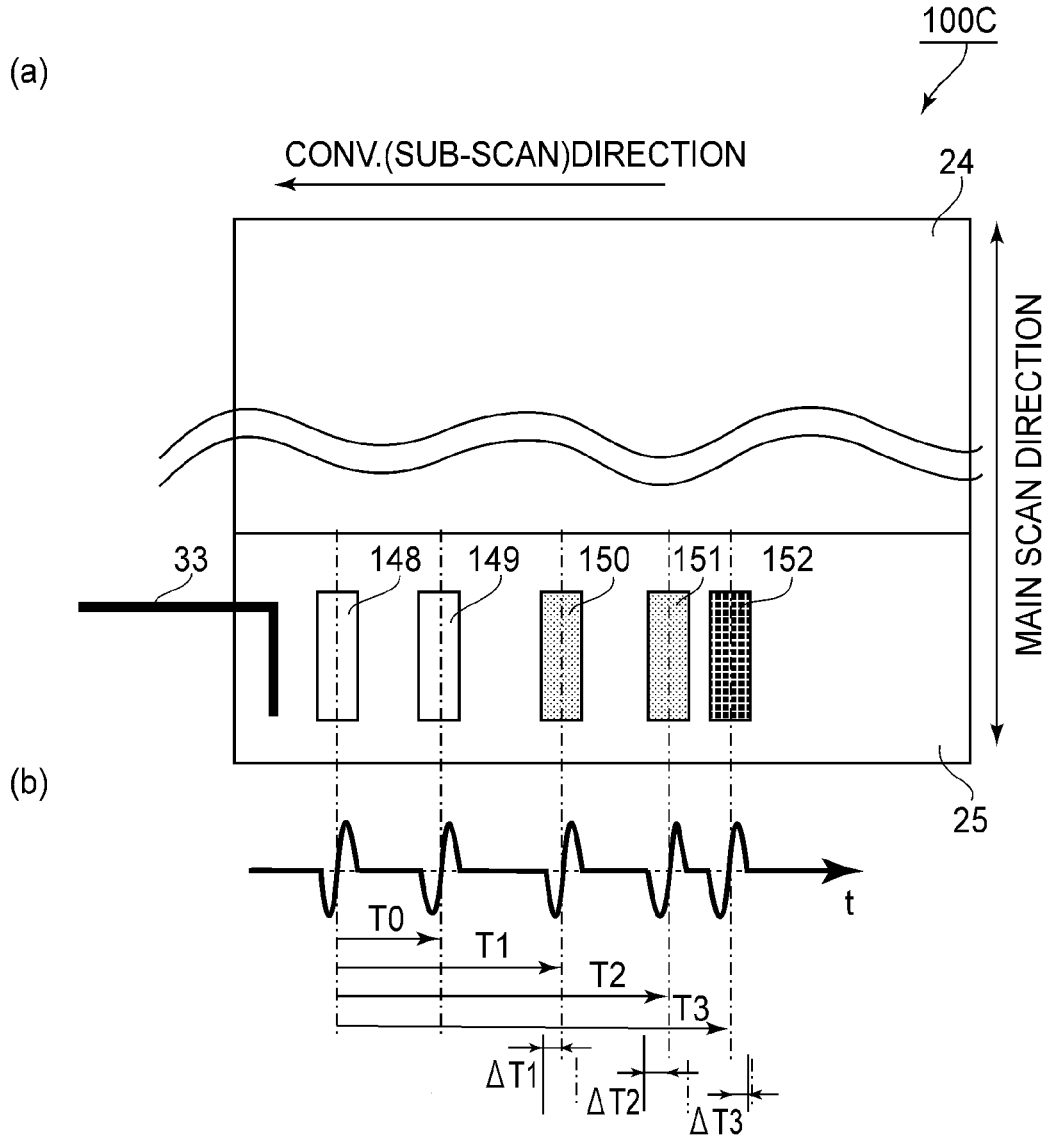

Parts (a) and (b) of FIG. 27 are illustrations of a state in which positional deviation of an electrostatic index image occurs.

DESCRIPTION OF THE PREFERRED EMBODIMENTS

Embodiments of the present invention will be described specifically with reference to the drawings. The present invention can also be carried out in other embodiments in which a part or all of constituent elements are replaced with their alternative constituent elements so long as an electrostatic index image is detected by an antenna potential sensor to adjust a transfer voltage or the like.

Therefore, when a plurality of toner images are superposed by using a belt member in an image forming apparatus, the present invention can be carried out irrespective of a difference of one drum tandem type, a difference of intermediary transfer type/recording material conveyance type, the number of image bearing members, a charging type of the image bearing members, an electrostatic image forming method, a developer and a developing method, a transfer method, and the like.

Figure 1:
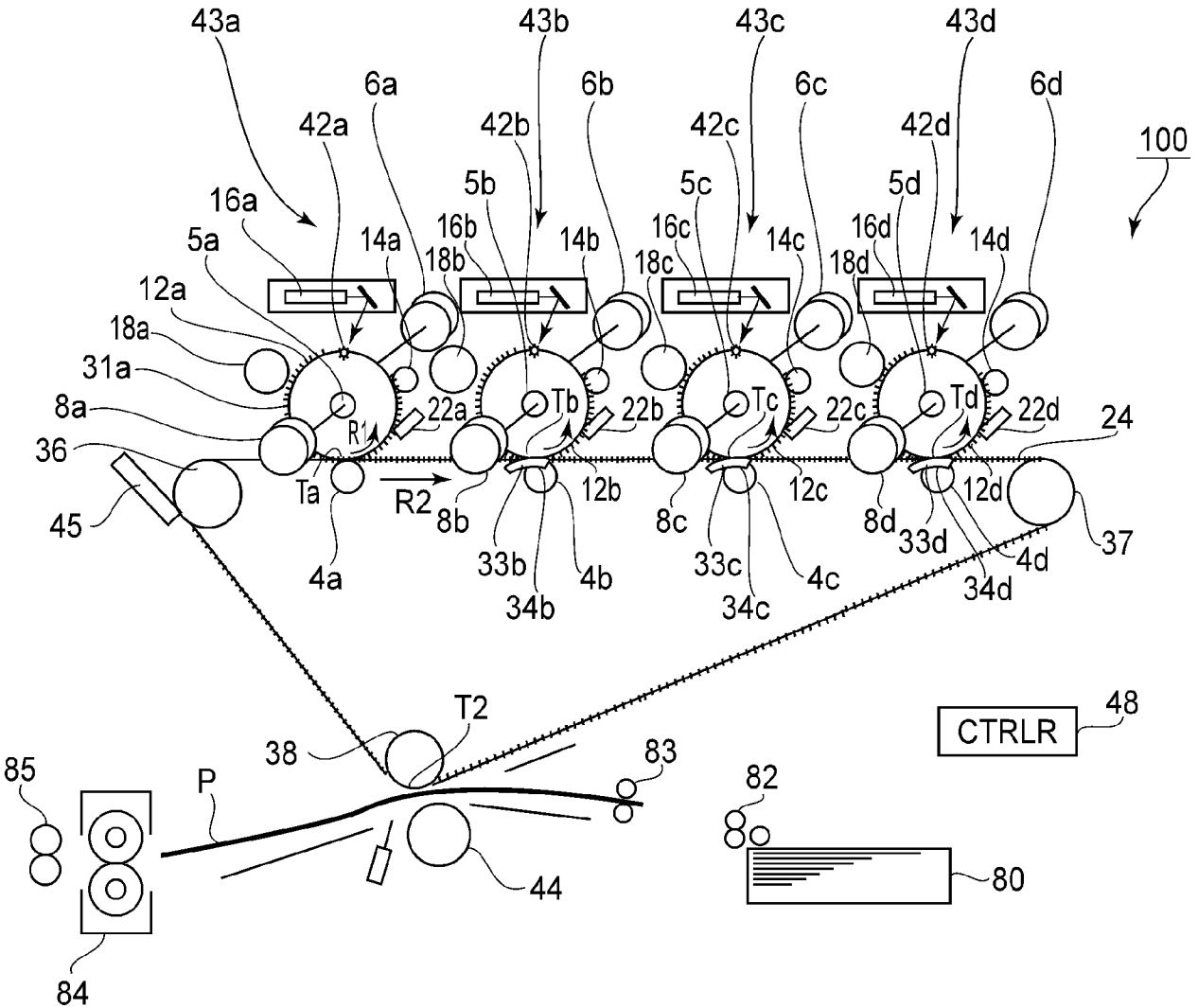
FIG. 1 is an illustration of a general structure of an image forming apparatus.

The toner image superposition control using the belt member is not limited to real-time adjustment during the image formation as shown in FIG. 1 but may include setting of exposure start timing effected during non-image formation.

Further, in this embodiment, only a principal part relating to toner image formation and transfer will be described but the present invention can be carried out by image forming apparatuses for various purposes such as printers, various printing machines, copying machines, facsimile machines and multi-function machines by adding necessary device, equipment and casing structure.

<Image Forming Apparatus>

FIG. 1 is an illustration of a general structure of the image forming apparatus.

As shown in FIG. 1, the image forming apparatus 100 is a full-color printer of the tandem type and of the intermediary transfer type, in which yellow, magenta, cyan and black image forming portions 43*a*, 43*b*, 43*c* and 43*d*, respectively, are arranged along an intermediary transfer belt 24.

In the image forming portion 43*a*, a yellow toner image is formed on a photosensitive drum 12*a*, and is transferred onto the intermediary transfer belt 24. In the image forming portion 43*b*, a magenta toner image is formed on a photosensitive drum 12*b*, and is transferred onto the intermediary transfer belt 24. In the image forming portions 43*c* and 43*d*, cyan and black toner images are formed on photosensitive drums 12*c* and 12*d*, respectively, and are transferred onto the intermediary transfer belt 24. After being transferred onto the intermediary transfer belt 24, the four toner images are conveyed to a second transfer portion T2 and then are secondary-transferred onto a recording material P.

The recording material P pulled out of a recording material cassette 50 is separated one by one by a separation roller 82 and then is conveyed to a registration roller 83, by which the recording material P is sent to a secondary transfer portion T2.

Then, in a process in which the recording material is conveyed through the secondary transfer portion T2, a positive voltage is applied to a secondary transfer roller 44, whereby the toner images are secondary-transferred from the intermediary transfer belt 24 onto the recording material P. The recording material P on which the toner images are secondary-transferred is conveyed to a fixing device 84. In the fixing device 84, the recording material P is subjected to heat and pressure, whereby the toner images are fixed and thereafter the recording material P is discharged to the outside of the image forming apparatus 100 by a discharging roller 85.

The intermediary transfer belt 24 is stretched around a tension roller 37, a belt driving roller 36 and an opposite roller 38, and to the intermediary transfer belt 24, a predetermined tension is applied by the tension roller 37. The belt driving roller 36 is rotationally driven by an unshown driving roller to rotate the intermediary transfer belt 24 in an arrow R2 direction at a predetermined process speed.

The image forming portions 43*a*, 43*b*, 43*c* and 43*d* have the same constitution except that the colors of the developers used by their developing apparatuses 18*a*, 18*b*, 18*c* and 18*d* are different from each other. In the following, the image forming portion 43*a* will be described. As for the image forming portions 43*b*, 43*c* and 43*d*, their descriptions are the same as the description of the image forming portion 43*a* except that the suffix "a" of reference numerals or symbols of constituent members of the image forming portion 43*a* is replaced with b, c and d, respectively.

The image forming portion 43*a* includes a charging roller 14*a*, an exposure device 16*a*, a developing device 18*a*, a primary transfer roller 4*a*, and a drum cleaning device 22*a*, which are disposed at the periphery of the photosensitive drum 12*a*.

The photosensitive drum 12*a* is prepared by forming a 30 μm-thick OPC (organic photoconductor) photosensitive layer having a negative charge polarity on an outer peripheral surface of an aluminum cylinder and is rotated in a direction indicated by an arrow R1 at a predetermined process speed. The charging roller 14*a* is supplied with an oscillating voltage in the form of a DC voltage biased with an AC voltage, so that the surface of the photosensitive drum 12*a* to a uniform negative dark-portion potential VD (−600 V).

The exposure device 16*a* effects scanning exposure with a laser beam through a rotating mirror, so that the surface potential of the photosensitive drum 12*a* is lowered to a light-portion potential VL (about −100 V) and thus the exposure device 16*a* writes the electrostatic image for the image on the photosensitive drum 12*a*. The developing device 18*a* develops the electrostatic image with a two-component developer containing a toner and a carrier, thus forming the toner image on the photosensitive drum 12*a*. At the exposed portion of the light-portion potential V1, the yellow toner is deposited and the electrostatic image is reversely developed into the yellow toner image.

The primary transfer roller 4*a* urges the inner surface of the intermediary transfer belt 24 to form a transfer position Ta between the photosensitive drum 12*a* and the intermediary transfer belt 24. By applying a positive DC voltage (about +1000 V) to the primary transfer roller 4*a*, the toner image is primary-transferred from the photosensitive drum 12*a* onto the intermediary transfer belt 24.

The drum cleaning device 22*a* slides a cleaning blade on the surface of the photosensitive drum 12*a* to collect transfer residual toner remaining on the surface of the photosensitive drum 12*a* without being transferred onto the intermediary transfer belt 24. A belt cleaning device 45 slides a cleaning blade on the surface of the intermediary transfer belt 24, supported by a driving roller 35 at the inner surface of the intermediary transfer belt 24, to collect from the surface of the intermediary transfer belt 24 the transfer residual toner passing through the secondary transfer portion T2.

To the photosensitive drum 12*a*, a driving force is transmitted via a driving system for transmitting the driving force from a drum driving motor 6*a* to a drum rotation shaft 5*a*. To the drum rotation shaft 5*a*, a drum encoder 8*a* is connected via an unshown coupling. At the image forming portion 43*a*, based on an output signal from the drum encoder 8*a*, the drum driving motor 6*a* is rotated, so that the photosensitive drum 12*a* is controlled so as to rotate in the arrow direction at the same angular speed.

On the other hand, the photosensitive drums 12*b*, 12*c* and 12*d* are, as described later, adjusted in real-time rotational speed on the basis of a detection signal of the electrostatic scale image 31*a* which is formed on the photosensitive drum 12*a* and then is transferred onto the intermediary transfer belt 24. As a result, with the toner image for the image formed on the photosensitive drum 12*a* and then transferred on the intermediary transfer belt 24, the toner images for the image on the photosensitive drums 12*b*, 12*c* and 12*d* are positionally aligned and then are superposed.

Corona chargers 46*a* and 46*b* are disposed so as to sandwich the electrostatic image transfer area 25 of the intermediary transfer belt 24. By applying AC voltages of opposite phases between the corona chargers 46*a* and 46*b*, the electrostatic scale image 31*a* which is formed on the photosensitive drum 12*a* and then is transferred onto the electrostatic image transfer area 25 of the intermediary transfer belt 24 to be used for the toner image superposition control is erased with reliability.

As a constitution for electrically discharging the electrostatic image transfer area 25 of the intermediary transfer belt 24, a discharging brush which is contacted to the electrostatic image transfer area 25 and is connected to the ground potential may also be disposed.

<Electrostatic Image Transfer Area>

Figure 2:
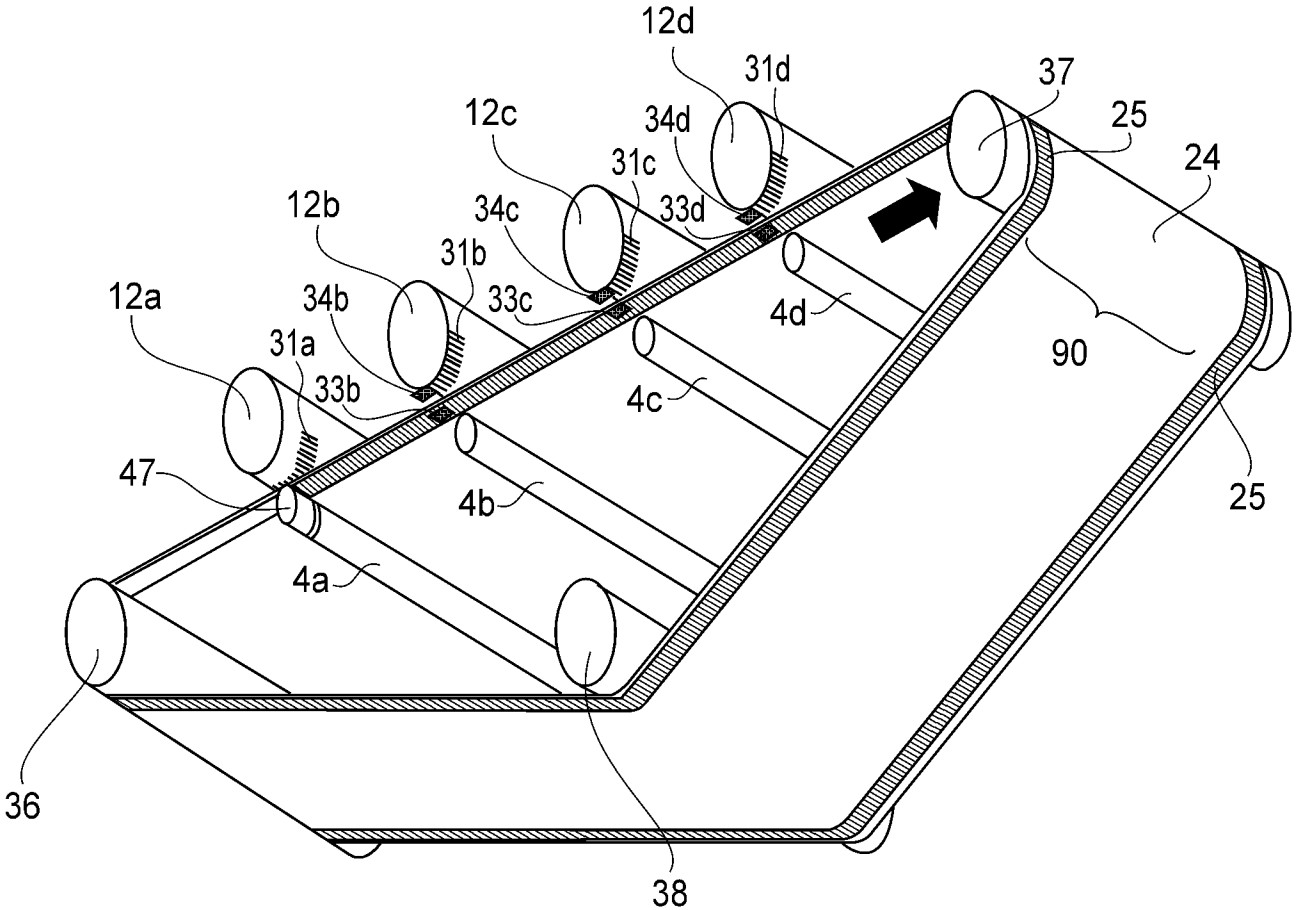
FIG. 2 is a perspective view showing transfer portions of toner images for an image on an intermediary transfer belt.

FIG. 2 is a perspective view showing transfer portions of the toner images for the image on the intermediary transfer belt. In the image forming apparatus of the tandem type including a plurality of image forming portions intended to realize speed-up, speed fluctuations of the plurality of photosensitive drums and the intermediary transfer belt and meandering of the intermediary transfer belt, and the like occur. As a result, at a transfer position of each image forming portion, a difference or the like in movement amount between an outer peripheral surface and the intermediary transfer belt occurs separately for each color and when the toner images are superposed, the respective movements amounts are not the same, so that color misregistration of 100-150 μm can occur.

Therefore, at the image forming portion of each color, the electrostatic image of a scale line is formed on the photosensitive drum and developed into a visible image and then is transferred onto the intermediary transfer belt. Then, the toner image of the scale line is detected by an optical sensor, so that the color misregistration was corrected.

However, when the toner is consumed in a period other than the printing period, it is insufficient from the viewpoint of effective use of resources. Further, it was difficult to detect the toner image of the scale line with accuracy due to contamination of the optical sensor or contamination and scars of the intermediary transfer belt.

Therefore, in the image forming apparatus 100, as the scale line for positional alignment, in place of the toner image, an undeveloped electrostatic image is used. The electrostatic scale image is formed on the upstreammost photosensitive drum 12*a* and is transferred onto the intermediary transfer belt 24 under application of the electric field, so that the electrostatic scale image is formed on the intermediary transfer belt.

As shown in FIG. 2, the intermediary transfer belt 24 which is an example of the belt member contacts the photosensitive drum which is an example of the image bearing member at a transfer portion of the toner image for the image. The intermediary transfer belt 24 is provided with the electrostatic image transfer area 25, in which the undeveloped electrostatic image is to be transferred, arranged in parallel to an image area used for transferring the toner image for the image. The exposure device 16*a* which is an example of an electrostatic image forming means forms the electrostatic image for the image on the photosensitive drum. At a downstream side of the photosensitive drum 12*a* with respect to the rotational direction of the intermediary transfer belt 24, the photosensitive drum 12*b* on which the magenta toner image for being superposed on the yellow toner image is to be formed is disposed.

The electrostatic scale image 31*a* which is an example of the electrostatic index image is formed on the photosensitive drum 12*a* by the exposure device 16*a*. The electrostatic scale image 31*a* is formed with contours, perpendicular to the rotational direction of the photosensitive drum 12*a*, arranged at intervals corresponding to a predetermined number of scanning lines for the exposure device 16*a*. The electrostatic scale image 31*a* is formed on the photosensitive drum 12*a* so that index (scale) portions thereof are arranged in a plurality of pitches each in which a plurality of the index portions are disposed. An electrostatic image transfer voltage controller 49 sets an electrostatic image transfer voltage so that an absolute value of the transfer voltage applied to an electrostatic image transfer roller 47 is increased with a decreasing pitch of the electrostatic index image.

The electrostatic image transfer roller 47 which is an example of an electrostatic image transfer member transfers the electrostatic scale image 31*a* onto the electrostatic image transfer area 25 in an undeveloped state. A belt scale reading sensor 33*b* which is an example of the antenna potential sensor detects an induced current of the electrostatic scale image 31*a* on the electrostatic image transfer area with rotation of the intermediary transfer belt 24. The belt scale reading sensor 33*b* is disposed at a position in which the magenta toner image is transferred from the photosensitive drum 12*a* onto the intermediary transfer belt 24, and detects the electrostatic scale image 31*a* which is formed on the photosensitive drum 12*a* and then is transferred onto the electrostatic image transfer area 25.

During the image formation, the electrostatic scale image 31*a* on the electrostatic image transfer area is detected by the belt scale reading sensor 33*b* and then superposition of the plurality of toner images to be transferred onto the image area is controlled. On the basis of a detection result of the electrostatic scale image 31*a*, transferred from the photosensitive drum 12*a*, by the belt scale reading sensor 33*b*, the real-time rotational speed of the photosensitive drum 12*b* is adjusted.

The intermediary transfer belt 24 is a resin belt of polyimide prepared by incorporating carbon particles therein to adjust a volume resistivity of $10^{10}$ ohm·cm and on which an effective image area 90 in which the toner image for the image is to be transferred is disposed at a widthwise central portion. At each of widthwise outsides of the effective image area 90, the electrostatic image transfer area 25 in which the electrostatic scale image 31*a* is to be transferred from the photosensitive drum 12*a* is disposed. The electrostatic image transfer area 25 is formed, in order to prevent attenuation of the transferred electrostatic scale image 31*a*, by laminating a resin film of PET, PTFE, polyimide or the like with the volume resistivity of $10^{14}$ ohm·cm or more on the surface of the intermediary transfer belt 24. However, the material for the electrostatic image transfer area 25 is not limited to these materials so long as the material is a high-resistance material which can be laminated on the intermediary transfer belt 24.

The effective image area 90 is formed, in order to ensure a transfer performance of the toner image for the image, of a medium-resistance material of $10^{9}$-$10^{10}$ ohm·cm in volume resistivity. For this reason, in the case where the electrostatic scale image 31*a* is directly transferred onto the intermediary transfer belt 24, electric charges are once moved, so that a charge pattern of the electrostatic scale image 31*a* is formed on the intermediary transfer belt 24. However, thereafter, the electric charges are moved due to a low resistance value and then disappear until the electrostatic scale image 31*a* reaches the downstream photosensitive drums 12*b*, 12*c* and 12*d*, thus being electrically undetectable.

Therefore, the electrostatic image transfer area 25 may preferably have the volume resistivity of $10^{14}$ ohm·cm or more. Although the degree of charge movement varies depending on the process speed, when the volume resistivity is $10^{14}$ ohm·cm or more, the electric charges transferred from the photosensitive drum 12*a* are held without being moved and reach the downstream photosensitive drums 12*b*, 21*c* and 12*d*, thus being electrically detected. For this reason, the electrostatic image transfer area 25 of a material having a volume resistivity value higher than that of the intermediary transfer belt 24 is applied onto the intermediary transfer belt 24. Alternatively, the electrostatic image transfer area 25 is applied onto the intermediary transfer belt 24 by spraying or coating by a doctor blade, followed by heat curing or the like, thus being increased in volume resistivity.

With respect to the material for the electrostatic image transfer area 25, when the material has the volume resistivity of $10^{14}$ ohm·cm or more and can be applied to the intermediary transfer belt 24, films of PET, fluorine-containing resin such as PTFE, polyimide or the like can be used but the material is not limited to these films.

In this embodiment, a 0.005 mm-tape (film) of polyimide with a width of 5 mm and the volume resistivity of $10^{14}$ ohm·cm or more is laminated on the outer surface of the intermediary transfer belt 24 with an adhesive to form the electrostatic image transfer area 25 on the intermediary transfer belt 24.

At each of longitudinal outsides of the primary transfer roller 4*a* for transferring the toner image for the image, the electrostatic image transfer roller 47 for transferring the electrostatic scale image 31*a* is disposed coaxially with the primary transfer roller 4*a*. The primary transfer roller 4*a* and the electrostatic image transfer roller 47 are constituted by an electroconductive sponge roller having the same material and structure. However, an optimum transfer voltage for the toner image transfer and an optimum transfer voltage for the electrostatic scale image 31*a* are generally different from each other and therefore the electrostatic image transfer roller 47 is electrically independent from the primary transfer roller 4*a* and to these rollers, separate transfer voltages are applied.

The primary transfer roller 4*a* is supplied with a constant voltage (about +1000 V) determined so as to provide a predetermined value of a current passing through the transfer portion, so that the toner image on the photosensitive drum 12*a* is electrostatically attracted and transferred to the effective image area 90 of the intermediary transfer belt 24.

The electrostatic image transfer roller 47 is supplied with a constant voltage (e.g., +500 V) different from the constant voltage applied to the primary transfer roller 4*a*, so that the electric charges constituting the electrostatic scale image 31*a* are transferred onto the electrostatic image transfer area 25.

Incidentally, a constitution for transferring the electrostatic scale image 31*a* onto the intermediary transfer belt 24 is not limited to the electroconductive sponge roller but may also be a corona charger using a wire or a blade charger.

<Transfer Portion of Electrostatic Scale Image>

Figure 3:
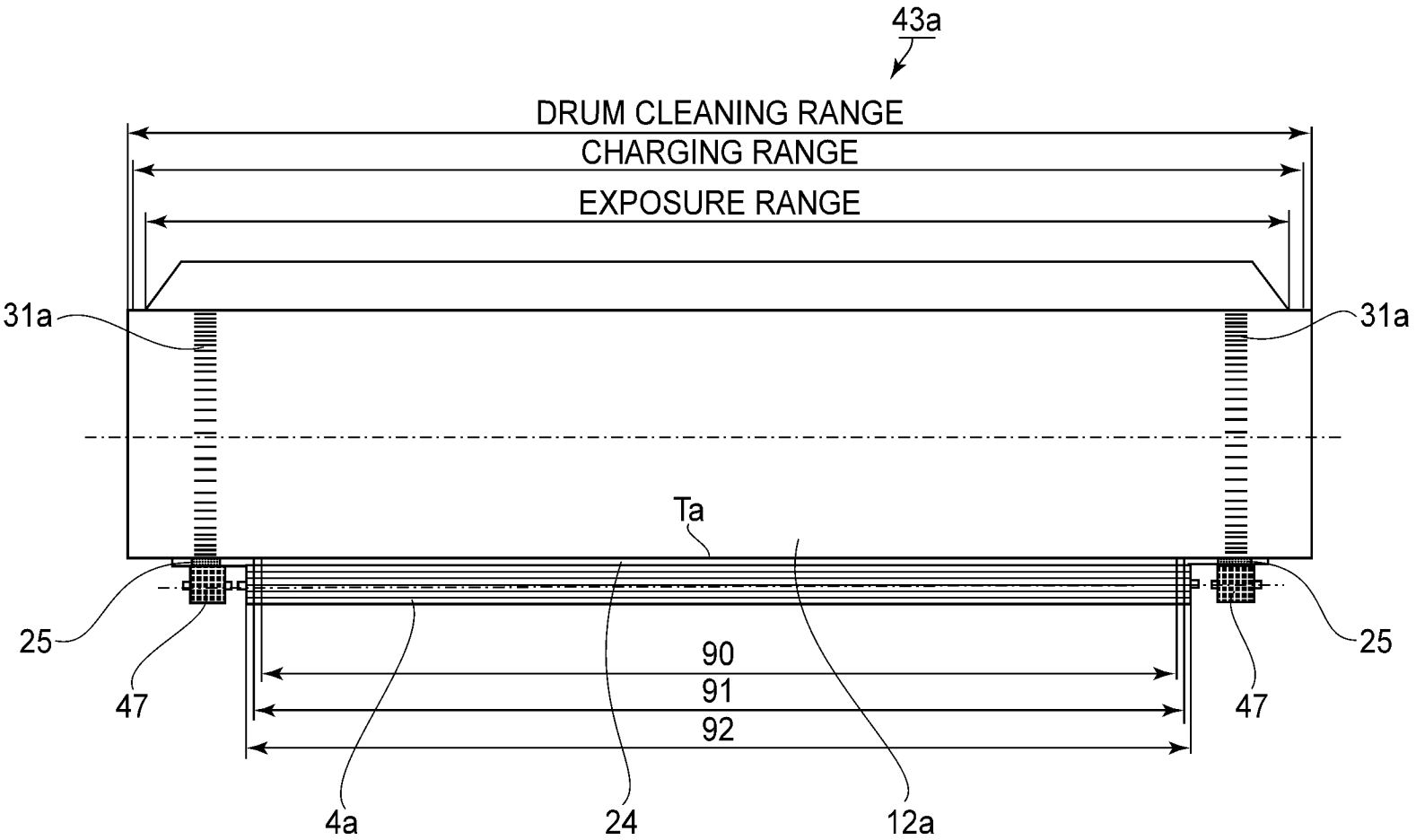
FIG. 3 is an illustration of a constitution of a yellow image forming portion.
Figure 4:
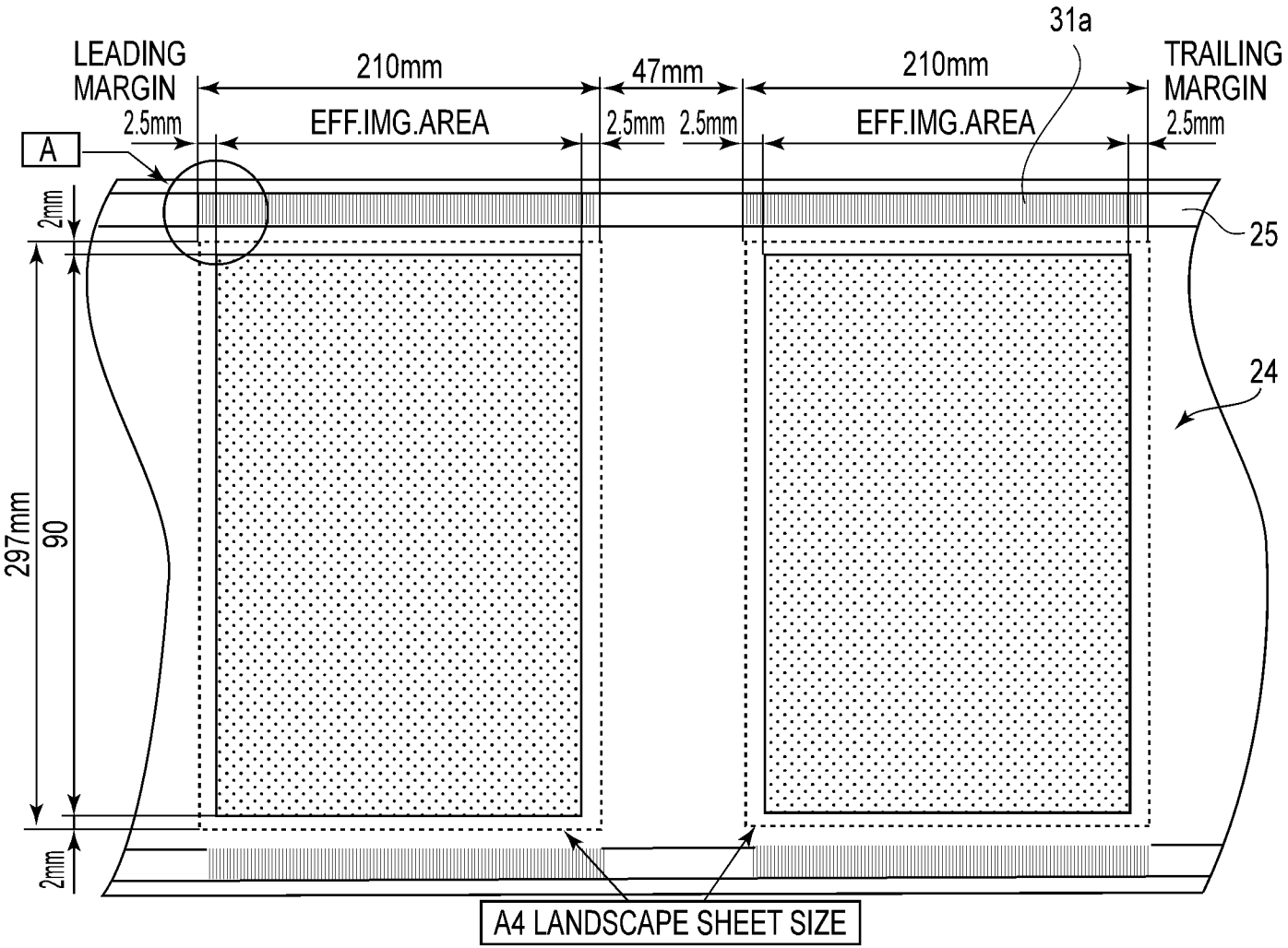
FIG. 4 is an illustration of an electrostatic scale image transferred onto an intermediary transfer belt.

FIG. 3 is an illustration of a constitution of the yellow image forming portion. FIG. 4 is an illustration of the electrostatic scale image transferred on the intermediary transfer belt.

As shown in FIG. 3 with reference to FIG. 1, at each of end portions, outside the effective image area 90, extended from the exposure position 42*a* of the photosensitive drum 12*a*, the electrostatic scale image 31*a* is written (formed) by laser light irradiation before or after the image writing. A length of the electrostatic scale image 31*a* is about 5 mm with respect to a main scan direction (longitudinal direction) of the photosensitive drum 12*a*. The electrostatic scale image 31*a* is formed immediately after start of the rotational drive of the photosensitive drum 12*a* before the image is written on the photosensitive drum 12*a* and is continuously written until the image formation of the photosensitive drum 12*a* is ended.

When the toner image is transferred from the photosensitive drum onto the intermediary transfer belt and then is transferred from the intermediary transfer belt onto the recording material P, a transfer operation is generally performed with a speed difference of about 0.5% while sliding adjacent members on each other. However, in this embodiment, for simplicity of explanation, the toner image with the same size as that after transfer on the recording material P is formed on the photosensitive drum and then is transferred onto the intermediary transfer belt with a sliding amount of zero in a conveyance direction.

As shown in FIG. 4 with reference to FIG. 3, at the image forming portion 43*a*, the toner image to be transferred onto the recording material P with an A4 landscape size is transferred onto the intermediary transfer belt 24 while the electrostatic scale image 31*a* is transferred onto the electrostatic image transfer area 25. At each of the widthwise end portions of the intermediary transfer belt 24, the electrostatic image transfer area 25 is formed and the electrostatic scale image 31*a* is transferred on the electrostatic image transfer area 25.

With respect to the A4 landscape recording material (recording paper) P, the image formation cannot be effected on the whole surface but is effected with margins at leading, trailing, left and right end portions. The margins at the leading and trailing end portions are 2.5 mm, and the margins at the left and right end portions are 2.0 mm. When the image formation for one page is effected on the photosensitive drum 12*a* at the image forming portion 43*a*, the exposure operation is started from a portion corresponding to the leading end of the recording material P, and the formation of the electrostatic scale image 31*a* is started from a position of 2.5 mm before the toner image forming area at the longitudinal end portions of the photosensitive drum 12*a*.

A magnitude (pitch) of the electrostatic scale image 31*a* with respect to a sub-scan direction (rotational direction) is represented by a width of the scanning lines. In the case where a resolution of the image is 600 dpi, a minimum pitch of the electrostatic scale image 31*a* is one line and one space, i.e., 25.4/600×2=0.08466 . . . mm, thus being 84.6 μm. However, as described later, in this embodiment, the electrostatic scale image 31*a* with the pitch of 4 lines and 4 spaces is employed and thus the pitch is 338.4 μm.

In the effective image area 90 of the photosensitive drum 12*a*, the yellow toner negatively charged by the developing device 18*a* is deposited, so that the yellow toner image is formed. At this time, so as to prevent the toner from being deposited on the photosensitive drum 12*a* at the longitudinal end portions, a developing area 91 of the developing device 18 is determined. On the other hand, the electrostatic image transfer area 25 is provided at each of the widthwise end portions of the intermediary transfer belt 24, and the electrostatic image transfer roller 47 is disposed at a portion where the electrostatic image transfer area 25 is present.

The electrostatic scale image 31*a* formed on the photosensitive drum 12*a* controls the electrostatic image transfer area 25 at the end portions of the intermediary transfer belt 24. Further, the predetermined constant voltage (e.g., +500 V) is applied to the electrostatic image transfer roller 47, so that a part of the electric charges constituting the electrostatic scale image 31*a* is transferred onto the electrostatic image transfer area 25. As a result, the electrostatic scale image 31*a* with the same pitch as that on the photosensitive drum 12*a* is formed in the electrostatic image transfer area 25.

In this case, a potential difference between the exposed portion (−100 V) and the electrostatic image transfer area 25 (+500 V) is 600 V and on the other hand a potential difference between the unexposed portion (−600 V) and the electrostatic image transfer area 25 (+500 V) is 1100 V. Due to this difference in potential difference, a difference in electric charge movement amount by electric discharge between the photosensitive drum 12*a* and the electrostatic image transfer area 25 is caused, so that the charge movement amount by the electric discharge is increased at the unexposed portion but is decreased at the exposed portion. As a result, the electrostatic scale image 31*a* is transferred as a pattern from the photosensitive drum 12*a* onto the electrostatic image transfer area 25.

Here, when the volume resistivity of the intermediary transfer belt 24 is $10^{10}$ ohm·cm and the volume resistivity of the electrostatic image transfer area 24 is $10^{10}$ ohm·cm, a surface potential of the electrostatic scale image 31*a* transferred on the electrostatic image transfer area 25 was measured. The electrostatic scale image 31*a* is minute and its potential cannot be measured directly. Therefore, the electrostatic scale image with the exposed and unexposed portions each corresponding to 1000 scanning lines (42.3 mm), i.e., with a length of 84.6 mm is formed and transferred onto the electrostatic image transfer area 25, and then a voltage in the electrostatic image transfer area 25 was measured by a conventional potential sensor of an electrostatic capacity type. As a result, the potential difference between −600 V and −100 V on the photosensitive drum 12*a* was changed to that between +50 V and 0 V on the electrostatic image transfer area 25.

<Detecting Portion of Electrostatic Scale Image>

Figure 5:
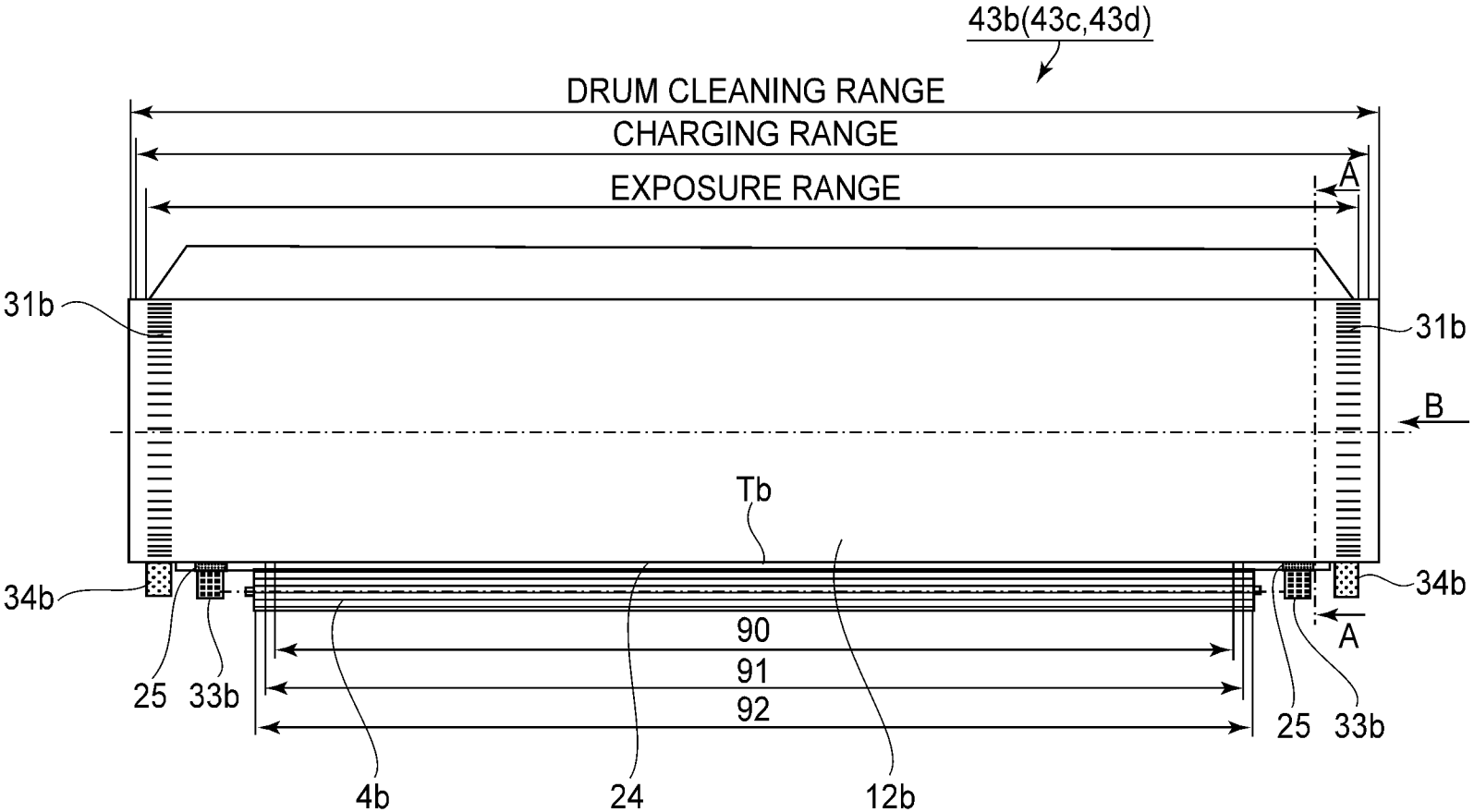
FIG. 5 is an illustration of a constitution of a magenta image forming portion.

FIG. 5 is an illustration of a constitution of the magenta image forming portion. Parts (a) and (B) of FIG. 6 are illustrations of arrangement of the antenna potential sensor. In FIG. 6, (a) shows the arrangement of a drum scale reading sensor, and (b) shows the arrangement of the belt scale reading sensor. As described above, at the image forming portions 43*b*, 43*c* and 43*d*, the toner image superposition control is similarly executed by using the substantially same constitution and therefore in the following, the image forming portion 43*b* will be described and other image forming portions 43*c* and 43*d* will be omitted from redundant explanation.

As shown in FIG. 5 with reference to FIG. 1, at the image forming portion 43*b*, the photosensitive drum 12*b* having the same shape as the photosensitive drum 12*a* at the image forming portion 43*a* was used and the belt scale reading sensor 33*b* was disposed on the inner surface of the intermediary transfer belt 24. The electrostatic scale image 31*a* transferred on the outer surface of the intermediary transfer belt 24 is detected from the inner surface of the intermediary transfer belt 24, so that the belt scale reading sensor 33*b* can be disposed without causing interference with the photosensitive drum 12*a*. Further, compared with the outer surface of the intermediary transfer belt 24, scattered toner is prevented from entering a sensor sliding surface.

In an exposure range at each of the end portions of the photosensitive drum 12*b* protruded from the end portions of the intermediary transfer belt 24, an electrostatic scale image 31*b* is formed in synchronism with the electrostatic image for the magenta image. The electrostatic scale image 31*b* is formed with the same pitch and length as those of the electrostatic scale image 31*b* formed on the photosensitive drum 12*a* shown in FIG. 3.

As shown in (a) of FIG. 6, on a transfer line of a transfer portion Tb where the toner image for the magenta image is to be transferred from the photosensitive drum 12*b* onto the intermediary transfer belt 24, the drum scale reading sensor 34*b* for reading the electrostatic scale image 31*b* on the photosensitive drum 12*b* is disposed. Further, as shown in (b) of FIG. 6, on the same transfer line, the belt scale reading sensor 33*b* for reading the electrostatic scale image 31*a* transferred on the electrostatic image transfer area 25 of the intermediary transfer belt 24 is disposed.

That is, at the image forming portion 43*b*, the belt scale reading sensor 33*b* and the drum scale reading sensor 34*b* are arranged on the same transfer line. Further, the electrostatic scale image 31*b* on the photosensitive drum 12*b* and the electrostatic scale image 31*a* with a one-to-one correspondence with the electrostatic scale image 31*b* are simultaneously read.

Therefore, relative to the electrostatic scale image 31*a* in the electrostatic image transfer area 25, the corresponding electrostatic scale image 31*b* on the photosensitive drum 12*b* is subjected to real-time positional alignment. As a result, the magenta toner image on the photosensitive drum 12*a* is positionally aligned with the yellow toner image on the intermediary transfer belt 24 at a scanning line level.

Incidentally, the belt scale reading sensor 33*b* may also be disposed on the outer (front) surface of the intermediary transfer belt 24. In the case where the electrostatic scale image 31*a* transferred on the outer surface of the intermediary transfer belt 24 is detected from the outer surface of the intermediary transfer belt 24, a distance between the belt scale reading sensor 33*b* and the electrostatic scale image 31*a* is short, so that the electrostatic scale image 31*a* with a smaller pitch is detectable. As a result of an experiment, with respect to the intermediary transfer belt 24, in the case where the electrostatic scale image 31*a* is detected from the outer surface, it is possible to read the electrostatic scale image 31*a* with one line and one space but in order to read the electrostatic scale image 31*a* from the inner surface with necessary accuracy, there was a need to provide 4 lines and 4 spaces.

Therefore, whether the electrostatic scale image 31*a* in the electrostatic image transfer area 25 is read from the outer surface or inner surface of the intermediary transfer belt 24 is selectable depending on characteristics of electrostatic image transfer process members including the photosensitive drums and the intermediary transfer belt and on product specifications.

The electrostatic scale image reading sensor 34*b* and the belt scale reading sensor 33*b* are, as shown in (a) and (b) of FIG. 7, a potential sensor 330 which is capable of detecting a change in space potential and has the same constitution.

<Antenna Potential Sensor>

Parts (a) and (b) of FIG. 7 are illustrations of a structure of the antenna potential sensor. Parts (a) and (b) of FIG. 8 are illustrations of reading of the electrostatic scale image by the antenna potential sensor. Parts (a), (b) and (c) of FIG. 9 are illustrations of output signals of the antenna potential sensor. Parts (a), (b) and (c) of FIG. 10 are illustrations of signal waveforms of the output signals. The basic structure of the potential sensor 330 is disclosed in detail in JP-A Hei 11-183542. Here, only a portion peculiar to the potential sensor 330 will be described.

As shown in (a) of FIG. 7, an electrically conduction metal wire 33*a* of 20 μm in diameter is bent in L-shape, and the end portion thereof constitutes a detecting portion 334 of about 2 mm in length. The opposite end of the sensor 330 from the detecting portion 334 is a signal outputting portion 335.

On a base film 332 which is made of polyimide and which is 4 mm in width, 15 mm in height length and 25 μm in thickness, the L-shaped conductive wire 313 is placed on the base film 332 after the base film 332 is coated with adhesive. A protective film 333 which is made of polyimide and is the same in width, length, and thickness as those of the base film 332 is bonded so as to cover the L-shaped conductive wire 331.

As shown in (a) of FIG. 8, the electrostatic scale image 31*a* is an incremental pattern below which alternately appearing a relatively high potential portion 341 and a relatively low potential portion 342 are provided. The low potential portion 342 of the electrostatic image transfer area 25 is, as described above, the portion where the exposed portion of the photosensitive drum 12*a* is transferred and is about 0 V in surface potential. Further, the high potential portion 341 of the electrostatic image transfer area 25 is the portion where the unexposed portion of the photosensitive drum 12*a* is transferred and is about +50 V in surface potential. The electrostatic scale image 31*a* is formed with an image resolution of 600 dpi in an alternately appearing pattern of the exposed portion of 4 lines and the unexposed portion of 4 spaces and therefore is 169 μm in width of the high potential portion, 169 μm in interval of the low potential portion and 338 μm in pitch of one cycle (period).

The potential sensor 330 as the belt scale reading sensor 33 is positioned so that the detecting portion 334 and the scale line of the electrostatic scale image 31*a* are parallel to each other and is fixed at its base portion on an unshown supporting portion.

As shown in (b) of FIG. 8, the potential sensor 330 is bent at its end portion so that the base film 332 thereof contacts the intermediary transfer belt 24. By a spring force of the bending, the potential sensor 330 is intimately contacted to the intermediary transfer belt 24 but may also be urged from the protective film 333 so as not to fluctuate a gap between the conductive wire 331 (detecting portion) and the intermediary transfer belt 24.

As shown in (a) of FIG. 9, a potential distribution of the high potential portion 34' and low potential portion 342 of the electrostatic scale image 31*a* is, since a laser exposure spot has a Gaussian distribution-like light amount distribution, such that the potential is decreased at a peripheral portion and the shape of the distribution is not a rectangular wave-like shape. Along the electrostatic scale image 31*a* having such a potential distribution, when the potential sensor is relatively moved as shown in (a) of FIG. 8, a signal output as shown in (c) of FIG. 9 is obtained in response to the potential distribution of the high potential portion 341 and the low potential portion 342. The potential in the neighborhood of the potential sensor 330 is changed with the relative movement, so that an induced current is generated at the detecting portion 334 of the potential sensor 330. From the outputting portion 335 of the potential sensor 330, an output voltage having a waveform obtained by differentiating the potential distribution shown in (b) of FIG. 9 is outputted.

A point of the peak (slope: zero) of the potential distribution shown in (b) of FIG. 9 is a position of the center line of the electrostatic scale image 31*a*. At the center line position, the output voltage of the potential sensor 330 is zero. Therefore, the time when the output voltage of the potential sensor is zero can be identified as a time when the scale line of the electrostatic scale image 31*a* is detected.

In (c) of FIG. 9, the pitch of the electrostatic scale image 31*a* is sparse and thus a time interval from the occurrence of the potential change until a subsequent potential change occurs is increased to some extent, so that the output signal of the potential sensor 330 is different in shape from a sine wave.

As shown in (a) of FIG. 10, in the case where the electrostatic scale image 31*a* is formed with 2 lines and 2 spaces, i.e., with the pitch of 169 μm which is ½ of that in the case where the electrostatic scale image 31*a* is formed with 4 lines and 4 spaces, the resultant potential distribution is as shown in (b) of FIG. 10, so that the potential sensor 330 provides the output signal of the sine wave as shown in (c) of FIG. 10.

<Image Positional Alignment Control>

FIG. 11 is an enlarged view of the electrostatic scale image at a leading end of an image on the intermediary transfer belt. FIG. 12 is an illustration of scale alignment between a photosensitive drum and the intermediary transfer belt. FIG. 13 is a block diagram of scale alignment control. FIG. 14 is a flow chart of the scale alignment control. The photosensitive drums 12*c* and 12*d* are controlled in the same manner as in the case of the photosensitive drum 12*b* and thus are not shown in FIGS. 13 and 14 and are omitted from redundant description.

As shown in FIG. 11, in order to perform scale alignment of the leading end of the image at the image forming portion 43*b* with reliability, at the leading end portion margin when the image formation for one page is effected, the scale with a pitch larger than that in the effective image area 90 is formed. FIG. 11 is an enlarged view of the portion A shown in FIG. 4 and shows a constitution of the electrostatic scale image formed in the margin of the image leading end portion.

On the intermediary transfer belt 24, 4 scale lines with the pitch which is 8 times the scale pitch in the effective image area are transferred from the photosensitive drum 12*a* and are formed at a portion corresponding to the leading end portion of the margin. Thereafter, 3 scale lines with the pitch which is ½ of the pitch for the 4 scale lines are formed and then 3 scale lines with the pitch which is ½ of the pitch for the preceding 3 scale lines are formed. Thereafter, scale lines with the same pitch as that in the effective image area are formed until the trailing end portion margin area. The area in which the scale lines with the pitches larger than the pitch in the effective image area is narrower than the area of the leading end portion margin.

On the photosensitive drum 12*b*, similarly as in the case of the photosensitive drum 12*a*, the scale lines are formed, from those with the pitch which is 8 times that in the effective image area, in such a manner that the pitch is gradually decreased from 8 times to 4 times and then to 2 times and is finally the same as that in the effective image area.

In the conventional image forming apparatus, the positional deviation of the image of about 100-150 μm occurs and therefore a maximum deviation of the position of the electrostatic scale image 31*b* at the transfer position of the image forming portion 43*b* from the position of the electrostatic scale image 31*a* transferred at the image forming portion 43*a* was about 150 μm. For this reason, the electrostatic scale image on either one of the photosensitive drum 12*b* and the intermediary transfer belt 24 is detected and then the other electrostatic scale image is always detected, so that corresponding scale lines are detected alternately. Therefore, with every detection of the electrostatic scale image 31*b* on the photosensitive drum 12*b*, the rotational speed of the photosensitive drum 12*b* is adjusted so that the electrostatic scale image 31*b* is positionally aligned with the electrostatic scale image 31*a* on the intermediary transfer belt 24. At the leading end portion margin, the scale pitch is gradually decreased, so that the positional alignment can be continuously effected until the detected scale line reaches those in the effective image area without losing sight of the corresponding scale.

FIG. 12 shows an image of the scale alignment control in the case where the leading end of the electrostatic scale image 31*b* on the photosensitive drum 12*b* is deviated by 150 μm from the electrostatic scale image 31*a* on the intermediary transfer belt 24. The leading scale line is merely deviated by about 150 μm at the maximum and therefore in FIG. 12, it is assumed that the leading scale m0 on the photosensitive drum 12*b* is deviated by 150 μm from the leading scale M0 on the intermediary transfer belt 24. In order to align the subsequent scales with each other, the rotational speed of the drum driving motor 6*b* is changed on the basis of a reading result of the positions of the respective scales, so that the photosensitive drum 12*b* is operated so as to positionally align the subsequent scale lines m1 and M1 with each other. However, a positional error is excessively large, so that the scale lines m1 and M1 are not completely aligned with each other. Then, when the rotation control is effected so as to positionally align the scale lines m2 and M2 with each other and positionally align the scale lines m3 and M3 with each other, the scale lines can be substantially aligned with each other. Thereafter, even when the scale pitch is decreased, the electrostatic scale image 31*b* on the photosensitive drum 12*b* can be continuously aligned with the electrostatic scale image 31*a* on the intermediary transfer belt 24. This is also true for the maximum scale pitch. As a result, from the leading end of the effective image, the electrostatic scale image 31*b* on the photosensitive drum 12*b* can be positionally aligned with the electrostatic scale image 31*a* on the intermediary transfer belt 24. That is, with respect to the toner image transferred on the intermediary transfer belt 24 at the image forming portion 43*a*, at the image forming portion 43*b* and the subsequent (downstream), image forming portions, the toner image can be continuously transferred onto the intermediary transfer belt 24 with less color misregistration.

As shown in FIG. 13, in the case where there is no speed fluctuation among the photosensitive drums 12*a* and 12*b* and the intermediary transfer belt 24 and thus the toner images are conveyed between the transfer positions Ta and Tb at a certain time interval, the toner image formed superposedly on the intermediary transfer belt 24 causes no positional deviation. However, the positional deviation occurs when speed non-uniformity of the intermediary transfer belt 24 or a speed fluctuation of the drum driving motors 6*a* and 6*b* is caused by eccentricity of the belt driving roller 36, thickness non-uniformity of the intermediary transfer belt 24, and the like. Further, the speed non-uniformity can also be corrected by measuring degrees of the eccentricity of the belt driving roller 36 and the thickness non-uniformity of the intermediary transfer belt 24 in advance. Further, the speed fluctuation of the drum driving motors 6*a* and 6*b* can also be corrected by drum encoders 8*a* and 8*b* mounted coaxially with each other.

However, due to a difference or the like in amount of the toner transferred at the image forming portions 43*a* and 43*b*, a tension fluctuation of the intermediary transfer belt 24 occurs, so that expansion and contraction different depending on the image occurs on the intermediary transfer belt 24. Such a tension fluctuation fluctuates a time until the toner image transferred on the intermediary transfer belt 24 at the image forming portion 43*a* reaches the image forming portion 43*b* to cause the color misregistration corresponding to a fluctuation time. A degree of the expansion and contraction of the intermediary transfer belt 24 varies depending on the transfer toner amount, a value of the primary transfer voltage or the like determined by a process condition and therefore the positional deviation due to the expansion and contraction cannot be predicted, so that it is difficult to correct the positional deviation.

Even in the case where such an unpredictable speed fluctuation of the intermediary transfer belt 24 occurs, the controller 48 controls the rotation of the drum driving motor 6*b* to prevent the color misregistration. The controller 48 controls the rotation of the drum driving motor 6*b* so that the electrostatic scale image 31*b* is positionally aligned with the corresponding electrostatic scale image 31*a* at the transfer position Tb.

As shown in FIG. 14 with respect to FIG. 13, when the controller 48 receives a printing start signal (S1), the controller 48 provides rotation start instructions to the drum driving motors 6*a* and 6*b* and an unshown belt driving motor. The controller 48 rotates the drum driving motors 6*a* and 6*b* at a constant speed, while reading the signals from the drum encoders 8*a* and 8*b*, so that the photosensitive drums 12*a* and 12*b* rotate in the direction indicated by the arrow R1 at a constant speed. Similarly, the controller 48 rotates the unshown belt driving motor at a constant speed by a signal of a belt driving roller encoder attached to the belt driving roller 36. Thus, the belt driving roller 36 is rotated to rotate the intermediary transfer belt 24 in the direction indicated by the arrow R2 at a constant speed (S2).

The controller 48 starts application of predetermined high voltages to the charging rollers 14*a* and 14*b* and the primary transfer rollers 4*a* and 4*b* (S3). As a result, the surface of each of the photosensitive drums 12*a* and 12*b* is charged to −600 V.

When the controller 48 receives image signals, it makes the exposing device 16*a* start an exposure operation to form the electrostatic scale image 31*a* with a predetermined pitch, starting from a portion corresponding to the leading end portion margin (S4). When the exposure operation of the image data is started, the exposure operation is continued until the exposure operation of the image data for one page is ended.

Here, the diameter of each photosensitive drum is 84 mm, and an image forming station pitch (distance between the image forming stations 43*a* and 43*b*) is 250 mm. Further, an exposure-transfer distance, that is, the distance from the exposure position of the photosensitive drum 12*a* to the transfer position Ta is 125 mm, and each of the belt conveyance speed and the process speed is 300 mm/sec. In this case, a waiting time from the start of the image formation at the image forming portion 43*a* to the start of the image formation at the image forming portion 43*b* is as follows.

$$250\ (\text{mm})/300\ (\text{mm/sec})=0.833\ (\text{sec})$$

Therefore, the controller 48 awaits the lapse of 0.833 second from the start of the exposure operation of the exposure device 16*a* (Yes of S5) and then starts the exposure operation of the exposure device 16*b* (S6).

Next, the controller 48 sets "i" at zero (i=0) (S7), and then detects the i-th (i=0) electrostatic scale image by the belt scale reading sensor 33*b* (S8*a*). Further, the controller 48 detects the i-th (i=0) electrostatic scale image by the drum scale reading sensor 34*b* (S8*b*). As shown in FIG. 12, the scale pitch in the leading end portion margin is increased 8 times and thus the scale line on the photosensitive drum 12*b* should be detected before detection of at least a subsequent scale line on the intermediary transfer belt 24.

Next, the controller 48 calculates the difference Δi in time between when the leading scale line of the electrostatic scale image on the photosensitive drum 12*b* was detected and when the leading scale line of the electrostatic scale image on the intermediary transfer belt 24 was detected (S3), and then compares the difference Δi with the value obtained by dividing a scale pitch Pi by the conveyance speed of 300 mm/sec (S10).

In the case where Δi is smaller than Pi/300 (Yes of S10), an associated scale line is detected before detection of the second scale line and thus it is clear that what scale line should be associated.

On the other hand, in the case where Δi is equal to or larger than Pi/300 (No of S10), the associated scale line cannot be detected until the second scale line is detected, and thus judgment that what associated scale line should be associated cannot be made. In that case, judgment that an error occurs is made and then the operation of the image forming apparatus is stopped (S11).

Then, based on the calculated difference Δi, the controller 48 calculates a correction amount of the speed of the drum driving motor 6*b* so as to eliminate the positional deviation of the electrostatic scale image between the photosensitive drum 12*b* and the intermediary transfer belt 24 (S12). Then, the controller 48 corrects the rotational speed of the drum driving motor 6*b* on the basis of the calculated correction amount (S13) and sets "i" at i+1 (S14). Thus, the controller 48 corrects the rotational speed of the drum driving motor 6*b* so that the scale pitch converges to the minimum pitch and also the positional deviation of the scale line becomes small until the detected scale line reaches the effective image area (S8*a* to S15).

The controller 48 repeats the above described process until the exposure operation of the image data for one page is ended (No in S15). When the exposure operation of the image data for one page is ended (Yes of S15), the controller 48 stops the exposure operation (S16).

In the case where there is a printing data for a subsequent page (Yes of S17), the controller 48 repeats image formation and the electrostatic scale image formation to effect image formation while performing the positional alignment of the images.

In the case where there is no printing data (No of S17), the controller 48 stops the high voltage application to the charging rollers 14*a* and 14*b*, the primary transfer rollers 4*a* and 4*b*, and the like (S18). When the secondary transfer onto the intermediary transfer belt 24 is completed (Yes of S19), the controller 48 stops the rotations of the photosensitive drums 12*a* and 12*b* and the intermediary transfer belt 24 (S20), and ends the printing operation (S21).

As described above, the position of the electrostatic scale image 31*b* associated with the toner image at the image forming portion 43*b* is aligned with the position of the electrostatic scale image 31*a* associated with the toner image transferred at the image forming portion 43*a*. The electrostatic scale images 31*a* and 31*b* associated with the toner images are detected by the potential sensors 330, so that the photosensitive drum 12*b* is operated so as to always positionally align the associated scale lines with each other.

Therefore, it becomes possible to superposedly transfer the toner image, at the image forming portion 43*b* with high accuracy, onto the toner image formed on the intermediary transfer belt 24, so that a full-color output image free from the color misregistration can be obtained. The positional deviation of the images due to the expansion and contraction of the intermediary transfer belt 24 can be corrected with high accuracy.

Further, the potential sensor 330 is prepared by only providing the conductive wire pattern on the flexible substrate and therefore can be constituted in a small size with a very low cost. The potential sensor 330 reads the electrostatic image itself and thus there is no need to use another writing/reading means, so that a positional deviation error with respect to the image can be reduced and thus it is possible to provide the image forming apparatus with accuracy.

<Problem of Electrostatic Scale Image>

As described above with reference to FIG. 3, it was turned out that the electrostatic image transfer voltage which is an example of an optimum electrical condition for the transfer of the electrostatic scale image 31*a* is changed with the environmental fluctuation similarly as in the case of the transfer voltage of the toner image for the image. When an electric resistance of the electrostatic image transfer roller 47 is changed with the environmental fluctuation, the position of the electrostatic scale image 31*a* on the intermediary transfer belt 24 is deviated from the position of the electrostatic scale image 31*b* on the photosensitive drum 12*b*.

Further, it was turned out that when the electrostatic image transfer voltage applied to the electrostatic image transfer roller 47 is optimized during the transfer of the electrostatic scale image 31*a* from the photosensitive drum 12*a* onto the intermediary transfer belt 24, the positional deviation amount is decreased.

Further, it was confirmed that depending on the difference in pitch of the electrostatic scale image 31*a* formed on the photosensitive drum 12*a*, the electrostatic image transfer voltage for transferring the electrostatic scale image 31*a* onto the intermediary transfer belt 24 while keeping the position deviation amount at a low level is changed. The optimum transfer voltage tends to lower with an increase in interval of the scale lines of the electrostatic scale image 31*a*.

This may be because in the case where the electrostatic image transfer voltage applied to the electrostatic image transfer roller 47 is improper, the contours of the scale lines of the electrostatic scale image 31*a* cannot be precisely transferred onto the electrostatic image transfer area 25. Further, that may be because when the contours of the scale lines of the electrostatic scale image 31*a* transferred on the electrostatic image transfer area 25 are disturbed, a sensing point of the induced current by the potential sensor 330 is liable to shift in the rotational direction. Further, that may be because the scale lines of the electrostatic scale image 31*a* are transferred as a whole and therefore the amount of the moved electric charges is liable to fluctuate with an increase in interval of the scale lines with the result that abnormal electric discharge occurs and is liable to disturb the contours.

Therefore, in the following embodiments, electrostatic image transfer voltage setting control by which the transfer voltage is modified to an optimum transfer voltage correspondingly to a change in optimum transfer voltage applied to the electrostatic image transfer roller 47 caused depending on the environmental fluctuation or the like.

Embodiment 1

FIG. 15 is a block diagram of control when an electrostatic image transfer voltage is optimized. FIG. 16 is a flow chart of electrostatic image transfer voltage setting control in Embodiment 1. FIG. 17 is an illustration of an electrostatic image setting pattern. FIG. 18 is a graph for illustrating an optimum electrostatic image transfer voltage. FIG. 19 is a graph showing a relationship between an electrostatic scale image pitch and the optimum electrostatic image transfer voltage. Parts (a) and (b) of FIG. 20 are graphs each showing a relationship between a time and an output voltage (amplitude of a detection signal) with respect to the electrostatic scale image pitch. FIG. 21 is a graph for illustrating a difference in amplitude of the detection signal depending on the electrostatic image transfer voltage.

In Embodiment 1, an electrostatic scale image 31 for adjusting the electrostatic image transfer voltage is formed on the photosensitive drum 12*a* at the image forming portion 43*a* and then is transferred onto the electrostatic image transfer area 25 of the intermediary transfer belt 24. The electrostatic image transfer voltage applied to the electrostatic image transfer roller 47 during the electrostatic image transfer has been changed at a plurality of levels. Thereafter, at the image forming portion 43*a*, the electrostatic scale image 31 for adjusting the electrostatic image transfer voltage is read by using the belt scale reading sensor 33*b* and then the electrostatic image transfer voltage providing a maximum amplitude of a detection signal is selected as an optimum value.

FIG. 15 is an enlarged view for illustrating only a relationship, of a constitution necessary to optimize the electrostatic image transfer voltage, among the image forming portions 43*a* and 43*b*, an electrostatic image transfer voltage controller 49 and an electrostatic image transfer voltage applying portion 50.

As shown in FIG. 15, the electrostatic image transfer voltage controller 49 forms the electrostatic scale image 31*a* during the non-image formation and transfers the electrostatic scale image 31*a* onto the electrostatic image transfer area 25 under an electrical condition different from that during the image formation, and then detects the electrostatic scale image 31*a* by the belt scale reading sensor 33*b*. The electrostatic image transfer voltage controller 49 sets, on the basis of a detection result, the electrical condition when the electrostatic scale image 31*a* is transferred onto the electrostatic image transfer area 25 during the image formation. The electrostatic image transfer voltage controller 49 sets the electrostatic image transfer voltage so that an amplitude of a detection signal of the electrostatic scale image 31*a* detected by the belt scale reading sensor 33*a* is increased. The electrostatic image transfer voltage controller 49 sets the electrostatic image transfer voltage so that a phase fluctuation of the detection signal of the electrostatic scale image 31*a* detected by the belt scale reading sensor 33*a* is decreased. The electrostatic image transfer voltage controller 49 sets the electrostatic image transfer voltage so that an amplitude fluctuation of the detection signal of the electrostatic scale image 31*a* detected by the belt scale reading sensor is decreased. The electrostatic image transfer voltage controller 49 applies the transfer voltage to the electrostatic image transfer roller 47 at the plurality of levels, so that the electrostatic scale image 31*a* is transferred onto the intermediary transfer belt 24. Further, the electrostatic image transfer voltage controller 49 sets, on the basis of the detection result of the electrostatic scale image 31*a* different in electrostatic image transfer voltage, the electrostatic image transfer voltage when the electrostatic scale image 31*a* is transferred onto the electrostatic image transfer area 25 during the image formation.

FIG. 17 shows, in a time-serial manner, the electrostatic scale image 31 formed on the photosensitive drum 12*a* during the electrostatic image transfer voltage setting control. In FIG. 17, the voltage applied to the electrostatic image transfer roller 47 is changed without providing a time difference but may be arbitrarily changeable depending on capacity of a power source or a load on a portion connected to the power source.

As shown in FIG. 16 with reference to FIG. 17, the electrostatic image transfer voltage controller 49 receives a signal during a pre-multi rotation which is a preparatory operation performed when the power source of the image forming apparatus is turned on, or during a post-rotation after the image formation (S1). Then, the electrostatic image transfer voltage controller 49 provides instructions to detect a temperature and a humidity in the neighborhood of the electrostatic belt scale transfer roller 47 which has the influence on the electrostatic image transfer efficiency of the electrostatic scale image 31*a* (S2).

Then, the electrostatic image transfer voltage controller 49 reads, on the basis of a detection result of the temperature and humidity, a table stored in a memory and then determines a range of the voltage applied to the electrostatic belt scale transfer roller 47 so that an optimum value of the electrostatic image transfer voltage is approximately a center value. The table stored in the memory is prepared before product shipment and includes a matrix of temperature (abscissa) and humidity (ordinate), and the range of the voltage applied to the electrostatic image transfer voltage applying portion 50 is determined every matrix section (S3).

As shown in FIG. 11, in the toner image positional alignment control during the image formation, each of the pitches of the electrostatic scale images 31*a* and 31*b* is gradually decreased from the maximum pitch to those of ½ time, ¼ time and ⅛ time, so that loss of sight of the scale lines is prevented. Further, an optimum electrostatic image transfer voltage is different every pitch of the electrostatic scale images 31*a* and 31*b*.

From the above, as shown in FIG. 17, on the photosensitive drum 12*a*, the electrostatic scale image 31 is formed so that scale lines are arranged in the pitch-decreasing order of those with the maximum pitch, those with ½-time pitch, those with ¼-time pitch and those with ⅛-time pitch.

The electrostatic image transfer voltage controller 49 starts control with i=0 (S4), and applies Vmin to the electrostatic image transfer roller 47 by using a minimum voltage determined from the table as Vmin (S5).

Then, the electrostatic image transfer voltage controller 49 starts the exposure operation of the exposing device 16*a* to form the electrostatic scale image 31, on the photosensitive drum 12*a*, necessary during the electrostatic image transfer voltage setting control (S6).

Then, the electrostatic image transfer voltage controller 49 successively transfers, when the electrostatic scale image 31 is moved to the transfer position Ta of the image forming portion 43*a*, the scale lines of the electrostatic scale image 31 with each of the pitches onto the intermediary transfer belt 24 to form the electrostatic scale image 31 in the electrostatic image transfer area 25.

Then, the electrostatic image transfer voltage controller 49 reads the electrostatic scale image 31 in the electrostatic image transfer area 25 by the belt scale reading sensor 33*b* disposed at the image forming portion 43*b* (S8). Reading timing is calculated based on a distance from the exposure position of the photosensitive drum 12*a* to the belt scale reading sensor 33*b* via the transfer position Ta, and the number of the scale lines with each of the pitches.

Then, the electrostatic image transfer voltage controller 49 performs average amplitude computation of an output of the belt scale reading sensor 33*b* with respect to the electrostatic scale image 31 with each of the pitches, and writes (stores) its result in the memory (S9).

Then, the electrostatic image transfer voltage controller 49 judges as to whether i=n or not (S10). Here, "n" represents the number of levels of the voltage applied to the electrostatic image transfer roller 47. For example, in the case of n=6, when Vmin in the step S5 is 650 V, the applied voltage is changed from 650 V to 950 V with an increment of 50 V when the electrostatic image transfer voltage is optimized.

The electrostatic image transfer voltage controller 49 adds, in the case where "i" is not "n" (No of S10), 1 to "i" to return the operation to the step S5. In a loop in which 1 is added to "i", compared with a preceding loop, the voltage to which 50 V is added is applied to the electrostatic image transfer roller 47. In this embodiment, the voltage is changed with the increment of 50 V but may also be changed with another increment.

The electrostatic image transfer voltage controller 49 executes a job in the above-described manner in the steps from S5 to S9. Then, when i=n (Yes of S10), the electrostatic image transfer voltage controller 49 selects an optimum electrostatic image transfer voltage (S11).

The electrostatic image transfer voltage controller 49 derives, for every pitch of the electrostatic scale image 31, a relationship between the applied voltage to the electrostatic image transfer roller 47 and an amplitude of a reading voltage by the belt scale reading sensor 33*b* as shown in FIG. 18, and then obtains the applied voltage providing a maximum amplitude.

As shown in FIG. 18, in the case where the electrostatic scale image 31 with a minimum pitch (⅛-time pitch of the maximum pitch), the voltage value of the belt scale reading sensor 33*b* is maximum at the applied voltage of 800 V. For this reason, the optimum electrostatic image transfer voltage is determined as 800 V.

FIG. 19 is a plot of values of the electrostatic image transfer voltage, applied to the electrostatic image transfer roller 47, providing a maximum amplitude at each of the pitches. This relationship between the pitch and the optimum electrostatic image transfer voltage is written in the memory of the electrostatic image transfer voltage controller 49 (S11).

Then, during the scale alignment control during the image formation as shown in FIG. 11, the electrostatic image transfer voltage is changed every scale line interval, so that the electrostatic image transfer of the electrostatic scale image 31*a* is performed.

According to the electrostatic image transfer voltage setting control in this embodiment, even when a change in electrical property depending on the environmental fluctuation or a material deterioration occurs, it becomes possible to perform the electrostatic image transfer of the electrostatic scale image with a small pitch and therefore the color misregistration can be corrected with high accuracy.

Next, a difference in detection waveform of the belt scale reading sensor 33*b* between the electrostatic scale image 31*a* with 8 dots and 8 spaces (pitch: 676.8 μm) and the electrostatic scale image 31*a* with 4 dots and 4 spaces (pitch: 338.4 μm) was checked.

First, the electrostatic scale image 31*a* with 8 dots and 8 spaces was formed on the photosensitive drum 12*a* and was transferred onto the electrostatic image transfer area 25 of the intermediary transfer belt 24, and then was detected by the belt scale reading sensor 33*b*. When the applied voltage to the electrostatic image transfer roller 47 for the electrostatic scale image 31*a* was changed to check the transfer voltage providing the maximum amplitude, as shown in (a) of FIG. 20, the transfer voltage was 800V.

Then, the electrostatic scale image 31*a* with 4 dots and 4 spaces was formed on the photosensitive drum 12*a* and was transferred onto the electrostatic image transfer area 25 of the intermediary transfer belt 24, and then was detected by the belt scale reading sensor 33*b*. Similarly as in the case of the electrostatic scale image 31*a* with 8 dots and 8 spaces, when the transfer voltage of 800 V was applied to the electrostatic image transfer roller 47 to transfer the electrostatic scale image 31*a* onto the electrostatic image transfer area 25, as shown in (b) of FIG. 20, a signal waveform was not obtained.

Therefore, in such a state in which the signal waveform was not obtained, when the electrostatic scale image 31*a* with 4 dots and 4 spaces was formed and the applied voltage to the electrostatic image transfer roller 47 is changed to check the transfer voltage providing the maximum amplitude, as shown in FIG. 21, the transfer voltage was 1000 V.

Incidentally, in Embodiment 1, when the electrostatic image transfer voltage is optimized during the non-image formation, as the belt scale reading sensor, the belt scale reading sensor 33*b* for the image forming portion 43*b* is used. However, the belt scale reading sensor 33*c* (33*d*) for the image forming portion 43*c* (43*d*) may also be used.

According to Embodiment 1, the toner image is not used as a positional index and therefore it becomes possible to effectively use the resources. Further, the positional detection marks by the electrostatic index image are formed with the optimized electrostatic image transfer voltage depending on the environment or the electrostatic index image interval and therefore writing accuracy onto the belt is improved, with the result that accuracy of the color misregistration correction can also be improved.

Embodiment 2

Parts (a) to (d) of FIG. 22 are illustrations of arrangement of potential sensors in Embodiment 2. FIG. 23 is a flow chart of electrostatic image transfer voltage setting control in Embodiment 2. FIG. 24 is a graph showing a relationship between an electrostatic image transfer voltage and standard deviation of a detection signal.

In Embodiment 1, the transfer accuracy of the electrostatic scale image 33*b* was evaluated by measuring the amplitude of the detection signal of the belt scale reading sensor 33*b*. On the other hand, in this embodiment, the transfer accuracy of the electrostatic scale image 31*a* is evaluated by measuring delay and leading of rise of the detection signal of the belt scale reading sensor.

As shown in (a) of FIG. 22, in this embodiment, two belt scale reading sensors 33*b* and 33*b*' each shown in (a) of FIG. 8 in Embodiment 1 are disposed in parallel along the direction perpendicular to the rotational direction of the intermediary transfer belt 24. By these two belt scale reading sensors 33*b* and 33*b*', the electrostatic scale image 31*a* in the electrostatic image transfer area 25 is detected. There are two cases where the electrostatic image transfer voltage is not optimized. One is the case where the transfer electric field when the electrostatic scale image 31*a* is excessively weak, so that the electrostatic scale image 31*a* is not transferred onto the electrostatic image transfer area 25. The other is the case where the transfer electric field when the electrostatic scale image 31*a* is excessively strong, so that electric discharge occurs even at the position in which the photosensitive drum 12*a* and the electrostatic image transfer area 25 are separated from each other and thus the contours of the transferred electrostatic scale image 31*a* is disturbed.

The shape of the electrostatic scale image 31*a* as shown in (a) of FIG. 22 is in an optimized state of the electrostatic image transfer voltage. As shown in (b) of FIG. 22, in the optimized state of the electrostatic image transfer voltage, rise of the output signal of the belt scale reading sensor 33*b* and rise of the output signal of the belt scale reading sensor 33*b*' coincide with each other, so that a degree of delay and leading is small. When the electrostatic image transfer voltage is appropriate, the electrostatic scale image is regularly transferred by normal electric discharge and therefore a degree of the transfer of the electrostatic scale image 31*a* and the reading accuracy are increased. A standard deviation σ of the difference in rise time between the output signals of the belt scale reading sensors 33*b* and 33*b*' approaches zero.

On the other hand, the shape of the electrostatic scale image 31*a* as shown in (c) of FIG. 22 is in a state in which the electrostatic image transfer voltage is excessively high to disturb the contours of the electrostatic scale image 31*a*. As shown in (d) of FIG. 22, in the improper state of the electrostatic image transfer voltage, rise of the output signal of the belt scale reading sensor 33*b* and rise of the output signal of the belt scale reading sensor 33*b*' fluctuation, so that a degree of delay and leading is large. The electrostatic scale image 31*a* is irregularly transferred by abnormal electric discharge and thus a standard deviation σ of the difference in rise time between the output signals of the belt scale reading sensors 33*b* and 33*b*' is increased.

Actually, even when the electrostatic image transfer voltage is appropriate and the electrostatic scale image 31*a* is transferred by the normal electric discharge, the standard deviation σ is deviated from zero due to some factors such as lateral deviation of the intermediary transfer belt 24, non-uniformity of the conveyance speed, a reading error by the potential sensor 330, and the like.

As shown in FIG. 23 with reference to FIG. 15, the steps from S1 to S7 are the same as those in the operation in Embodiment 1 described with reference to FIG. 16 and therefore will be omitted from explanation.

The electrostatic image transfer voltage controller 49 detects the electrostatic scale image 31*a* by the two belt scale reading sensors 33*b* and 33*b*'(S8). Specifically, as shown in (b) and (d) of FIG. 22, the time until the rise area of the output waveform passes through the point of the potential of zero is measured. The passing times of the two belt scale reading sensors 33*b* and 33*b*' are t1 and t1' (first), t2 and t2' (second), thus being measured at 1000 points in total until t1000 and t1000' (1000th).

Then, the electrostatic image transfer voltage controller 49 obtained dispersions of differences in passing time at each point between the two belt scale reading sensors 33*b* and 33*b*', i.e., (t1−t1'), (t2−t2') . . . , so that the standard deviation σ is calculated (S9). As described above, when the electrostatic image transfer voltage is appropriate, the standard deviation approaches zero and with an increase of degree of the improper electrostatic image transfer voltage, the standard deviation σ is deviated from zero. The values of the standard deviation σ are written in the memory of the electrostatic image controller 49.

Similarly as in Embodiment 1, the electrostatic image transfer voltage controller 49 increases the electrostatic image transfer voltage applied to the electrostatic image transfer roller 47 with the increment of 50 V and then formation, transfer and detection of the electrostatic scale image 31*a* are similarly performed to calculate the standard deviation (S5 to S10).

When the standard deviation σ at each of all the electrostatic image transfer voltages is obtained (Yes of S10), the electrostatic image transfer voltage controller 49 stores, as shown in FIG. 24, a plot of data showing a relationship between the electrostatic image transfer voltage and the standard deviation σ.

The electrostatic image transfer voltage controller 49 selects and writes the electrostatic image transfer voltage providing the minimum standard deviation σ in the memory (S11). In FIG. 24, the standard deviation σ is minimum at the electrostatic image transfer voltage of 800 V< so that the electrostatic image transfer voltage during the image formation is set at 800 V. Then, the electrostatic image transfer voltage controller 49 applies the electrostatic image transfer voltage of 800 V in the scale alignment control during the image formation.

According to the constitution in Embodiment 2, even when the electrical property is changed due to the environment or the material deterioration, the electrostatic scale image 31*a* with a small pitch can be transferred onto the electrostatic image transfer area 25 and thus it is possible to correct the color misregistration with high accuracy.

Embodiment 3

FIG. 25 is an illustration of the color misregistration correction control during the image formation in this embodiment.

As shown in FIG. 1, in Embodiment 1, the rotational speed of the photosensitive drum 12*b* was controlled in real time by reading the electrostatic scale image 31*a* on the intermediary transfer belt 24. On the other hand, in this embodiment, speed non-uniformity of the intermediary transfer belt 24 is removed in real time by reading the electrostatic scale image 31*a* on the intermediary transfer belt 24. A factor of the positional deviation due to the change in conveyance speed of the intermediary transfer belt 24 caused by eccentricity or friction of the belt driving roller 36 is eliminated.

As shown in FIG. 25, downstream of the photosensitive drum 12*d*, a first belt scale reading sensor 33 and a second belt scale reading sensor 39 are disposed at an interval smaller than the pitch of the electrostatic scale image 31*a* with respect to the rotational direction. Each of the first and second belt scale reading sensors 33 and 39 is the antenna potential sensor 330 shown in FIG. 7 and detects the same electrostatic scale image 31*a* transferred onto the electrostatic image transfer area 25 of the intermediary transfer belt 24.

On the photosensitive drum 12*d*, similarly as in Embodiment 1, the electrostatic scale image 31*a* is formed outside the effective image are 90 by using the exposure device 16*d* with exposure timing corresponding to 4 dots and 4 spaces and then is transferred onto the electrostatic image transfer area 25 by using the electrostatic image transfer roller 47.

The interval between the first and second belt scale reading sensors 33 and 39 is smaller than the pitch of the electrostatic scale image 31*a* and therefore a real-time movement speed of the intermediary transfer belt 24 can be calculated from the rise time difference of the detection signals at the same scale line. By performing similar detection and calculation with respect to the electrostatic scale image 31*a* including the scale lines arranged with a constant pitch with respect to the rotational direction, the movement speed fluctuation of the intermediary transfer belt 24 can be calculated.

Further, with respect to a large number of electrostatic scale images 31*a*, the respective movement speed values are computed to obtain an average, so that an average movement speed of the intermediary transfer belt 24 can be calculated.

The controller 48 drives the belt driving roller 36 so that the measured real-time movement speed of the intermediary transfer belt 24 approaches the average movement speed, so that the speed fluctuation of the intermediary transfer belt 24 is eliminated. The speed adjustment is performed so that the movement speed fluctuation of the intermediary transfer belt 24 is eliminated and is the average movement speed.

Alternatively, depending on the speed fluctuation of the intermediary transfer belt 24, the exposure timing or the rotational speed of the photosensitive drum 12*d* is adjusted so as to cancel the speed fluctuation, so that the positional deviation is corrected.

Further, also in an image forming apparatus 100B in this embodiment, in the same manner as in Embodiments 1 and 2, the electrostatic image transfer voltage applied to the electrostatic image transfer roller 47 can be optimized.

Parts (a) and (b) of FIG. 26 are illustrations of color misregistration correction control in Embodiment 4. Parts (a) and (b) of FIG. 27 are illustrations of a state in which positional deviation of an electrostatic index image occurs.

As shown in FIG. 1, in Embodiment 1, the electrostatic scale image 31*a* on the intermediary transfer belt 24 was read to control the rotational speed of the photosensitive drum 12*b* in real time. On the other hand, in this embodiment, four electrostatic index images transferred from the portions 12*a*, 12*b*, 12*c* and 12*d* onto the intermediary transfer belt 24 are read at a position downstream of the photosensitive drum 12*d*, so that exposure start timing for each of the photosensitive drums 12*a*, 12*b*, 12*c* and 12*d* is set.

As shown in FIG. 26 with reference to FIG. 1, the belt scale reading sensor 33 is disposed downstream of the photosensitive drum 12*d* and detects electrostatic index images 149, 150, 151 and 152 which are formed on the photosensitive drums 12*a*, 12*b*, 12*c* and 12*d*, respectively, and then are transferred onto the electrostatic image transfer area 25. During the image formation, on the basis of detection results of the electrostatic index images 149, 150, 151 and 152 by the belt scale reading sensor 33, a toner image formation timing on each of the photosensitive drums 12*a*, 12*b*, 12*c* and 12*d* is set.

Downstream of the photosensitive drum 12*d*, the belt scale reading sensor 33 is disposed. For each of the photosensitive drums 12*a*, 12*b* and 12*c*, the electrostatic image transfer roller (47: not shown) is disposed. On the photosensitive drums 12*a*, 12*b* and 12*c*, the electrostatic index images 152, 151 and 150 are formed, respectively, and are transferred onto the electrostatic image transfer area 25 of the intermediary transfer belt 24.

The two electrostatic index images 148 and 149 are reference scale lines during the detection of the color misregistration and are disposed at an interval equal to a spacing between adjacent drums of the photosensitive drums 12*a* to 12*d*. For that reason, when the electrostatic index images 149, 150, 151 and 152 are formed simultaneously on the photosensitive drums 12*a*, 12*b*, 12*c* and 12*d*, the electrostatic index images 148, 149, 150, 151 and 152 are transferred onto the electrostatic image transfer area 25 at regular intervals. By the belt scale reading sensor 33, the electrostatic index images 148, 149, 150, 151 and 152 are detected at the same time interval.

Therefore, when the time interval of the detection of the electrostatic index images 148, 149, 150, 151 and 152 by the belt scale reading potential sensor 330 (33) is measured, it is possible to detect an amount of the positional deviation when the toner image is transferred. On the basis of the detected time interval between the electrostatic index images 148 and 149, by adjusting writing start timing on each of the photosensitive drums 12*a*, 12*b* and 12*d*, the electrostatic index images 148, 149, 150, 151 and 152 can be transferred at regular intervals.

Specifically, an interval at a detection time between the electrostatic index images 148 and 149 which provide a reference positional relationship when the positional deviation is detected is T0. Further, the interval at the detection time between the electrostatic index images 149 and 150 is T1, that between the electrostatic index images 150 and 151 is T2, and that between the electrostatic index images 151 and 152 is T3. In this case, when the following relationships are satisfied, it can be said that the positional deviation of the toner image is zero.

$$T1=2\times T0$$

$$T2=3\times T0$$

$$T3=4\times T0$$

However, in the case where the toner image positional deviation occurs, as shown in FIG. 27, the intervals T1, T2 and T3 are not 2 times, 3 times and 4 times, respectively, the interval T0, so that positional deviation amounts ΔT1, ΔT2 and ΔT3 calculated by the following formulas are generated.

$$\Delta T1=T1-2\times T0$$

$$\Delta T2=T2-3\times T0$$

$\Delta T3=T3-4\times T0$

Correspondingly to these positional deviation amounts, the exposure start timing (or the photosensitive drum rotational speed) for the photosensitive drums 12*a*, 12*b* and 12*c* is adjusted, so that it is possible to correct the positional deviation.

Further, also in such an image forming apparatus 100C in Embodiment 4, the electrostatic image transfer area applied to the electrostatic image transfer roller 47 can be optimized in the same manners as in Embodiments 1 and 2. The electrostatic index image formed on the photosensitive drum 12*c* (12*b*, 12*a*) is transferred onto the electrostatic image transfer area while changing the electrostatic image transfer voltage and then is detected by the belt scale reading sensor 33, so that the electrostatic image transfer voltage evaluated as an optimum electrostatic image transfer voltage is set during the image formation.

In the image forming apparatus of the present invention, the electrostatic index image transferred under a proper electrical condition (current or voltage) and the electrostatic index image transferred under an improper electrical condition are discriminated on the basis of the detection result of the antenna potential sensor used in the toner image superposition control. Therefore, without adding a particular sensor or device, the electrical condition when the electrostatic index image is transferred can be adjusted with no excess and no deficiency. Further, even when accumulation of the image formation, the change of the temperature and the humidity, and the like occur, the electrostatic index image can be properly transferred onto the belt member, so that the superposition accuracy of the toner images can be maintained at a high level.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 254481/2010 filed Nov. 15, 2010, which is hereby incorporated by reference.

What is claimed is:

1. An image forming apparatus comprising:

a movable first image bearing member;

a first latent image forming unit configured to form an electrostatic latent image, including a first latent image and a first latent index pattern which are based on an image signal, on said first image bearing member;

a movable belt member configured to contact said first image bearing member;

a first toner image transfer member configured to transfer a first toner image, obtained by depositing a toner on the first latent image, onto said belt member;

a latent pattern transfer member configured to be disposed at a position corresponding to the first latent index pattern with respect to a widthwise direction of said belt member and to be supplied with a latent pattern transfer voltage, to transfer the first latent index pattern from said first image bearing member onto said belt member;

a movable second image bearing member configured to be disposed at a position downstream of said first image bearing member with respect to a moving direction of said belt member and to contact said belt member;

a second latent image forming unit configured to form an electrostatic latent image, including a second latent image and a second latent index pattern which are based on an image signal, on said second image bearing member;

a second toner image transfer member configured to transfer a second toner image, obtained by depositing the toner on the second latent image, onto said belt member;

a first latent pattern detector configured to be disposed opposed to said belt member at the position corresponding to the first latent index pattern with respect to the widthwise direction and at a position downstream of said latent pattern transfer member with respect to a moving direction of said belt member, and configured to detect a transferred first latent index pattern transferred by said latent pattern transfer member from said first image bearing member to said belt member;

a second latent pattern detector configured to be disposed opposed to said second image bearing member at a position corresponding to the second latent index pattern with respect to the widthwise direction and at a position downstream of said second latent image forming unit, and configured to detect the second latent index pattern;

an adjusting portion configured to adjust a relative position between the first latent index pattern and the second latent index pattern on said belt member with respect to the moving direction of said belt member, on the basis of detection results of said first latent pattern detector and said second latent pattern detector; and a setting portion configured to set the latent pattern transfer voltage, during image formation, on the basis of a detection result of said first latent pattern detector on condition that a plurality of test voltages are applied to said latent pattern transfer member during non-image formation.

2. The apparatus according to claim 1, wherein with respect to the widthwise direction, the first latent image and the second latent image are formed in a first area, the first latent index pattern is formed in a second area outside a first area, and the second latent index pattern is formed in a third area which is outside the first area and which does not overlap with the second area.

3. The apparatus according to claim 1, wherein during the image formation, a voltage to be applied to said first toner image transfer member and the latent pattern transfer voltage to be applied to said latent pattern transfer member are different from each other.

4. The apparatus according to claim 1, wherein said setting portion sets the latent pattern transfer voltage so that an amplitude of a detection signal of the transferred first latent index pattern detected by said first latent pattern detector is increased.

5. The apparatus according to claim 1, wherein said setting portion sets the latent pattern transfer voltage so that a phase fluctuation of a detection signal of the transferred first latent index pattern detected by said first latent pattern detector is decreased.

6. The apparatus according to claim 1, wherein said setting portion sets the latent pattern transfer voltage so that an amplitude fluctuation of a detection signal of the transferred first latent index pattern detected by said first latent pattern detector is decreased.

7. The apparatus according to claim 1, wherein each of the first and second latent index patterns is formed so that a plurality of linear patterns each having a predetermined width and each extending in the widthwise direction are arranged with a predetermined pitch in the moving direction of said belt member.

8. The apparatus according to claim 7, wherein each of the first and second latent index patterns is formed from a plurality of constant pitch portions so that each of the constant pitch portions has a constant pitch with respect to the moving direction of said belt member and so that the plurality of constant pitch portions include constant pitch portions different in pitch, and wherein when the first latent index pattern is transferred onto said belt member, said setting portion sets the latent pattern transfer voltage so that an absolute value of the latent pattern transfer voltage when forming the constant pitch portion having a first pitch is higher than an absolute value of the latent pattern transfer voltage when forming the constant pitch portion having a second pitch more than the first pitch.

9. The apparatus according to claim 1, wherein said adjusting portion adjusts a moving speed of each of said first and second image bearing members on the basis of the detection results of said first latent pattern detector and said second latent pattern detector during the image formation.

10. The apparatus according to claim 1, wherein said adjusting portion adjusts each of start timings to form the first and the second latent images by each of said first and said second latent image forming units on the basis of the detection results of said first latent pattern detector and said second latent pattern detector, during the image formation.

* * * * *